US011815329B2

(12) United States Patent
Yeates et al.

(10) Patent No.: US 11,815,329 B2
(45) **Date of Patent: *Nov. 14, 2023**

(54) HOLSTER WITH PUSHROD EJECTION PORT LOCKING ELEMENT

(71) Applicant: Sentry Solutions Products Group LLC, Virginia Beach, VA (US)

(72) Inventors: Eric M. Yeates, Virginia Beach, VA (US); Thomas M. Gregory, Belgrade, MT (US); Robert A. Kincaid, Manhattan, MT (US); Marcus Byrd, Los Gatos, CA (US)

(73) Assignee: Sentry Solutions Products Group LLC, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/567,363

(22) Filed: Jan. 3, 2022

(65) Prior Publication Data

US 2022/0128332 A1 Apr. 28, 2022

Related U.S. Application Data

(63) Continuation-in-part of application No. 16/876,461, filed on May 18, 2020, now Pat. No. 11,215,422, which is a continuation of application No. 16/209,824, filed on Dec. 4, 2018, now Pat. No. 10,655,931, which is a continuation-in-part of (Continued)

(51) Int. Cl.
*F41C 33/02* (2006.01)
*F41C 33/04* (2006.01)

(52) U.S. Cl.
CPC ..... *F41C 33/0263* (2013.01); *F41C 33/0236* (2013.01); *F41C 33/0272* (2013.01); *F41C 33/0218* (2013.01); *F41C 33/04* (2013.01)

(58) Field of Classification Search
CPC ..... F41C 33/0263; F41C 33/0236; F41C 33/0272; F41C 33/0218; F41C 33/04
USPC ..... 224/244
See application file for complete search history.

(56) References Cited

U.S. PATENT DOCUMENTS 3,866,811 A * 2/1975 Hamby ..... F41C 33/0263 224/244
3,910,469 A * 10/1975 Baldocchi ..... F41C 33/0245 224/678

(Continued)

*Primary Examiner* — Peter N Helvey
(74) *Attorney, Agent, or Firm* — Shaddock Law Group, PC

(57) ABSTRACT

A holster defining a holster cavity; a locking element extending from a rotation portion to a locking engagement portion, the rotation portion including a helical portion formed in or around at least a portion of the rotation portion, the locking engagement portion including a handgun locking portion, the locking element being rotatable between a locking element retention position and a locking element release position, in the locking element retention position at least a portion of handgun locking portion extends into at least a portion of the holster cavity; and a pushrod extending from a release lever, the pushrod being slidable between a release lever retention position and a release lever release position such that if the pushrod is urged to the release lever release position, interaction between the pushrod and the helical portion causes the locking element to rotate toward the locking element release position.

20 Claims, 26 Drawing Sheets

Related U.S. Application Data application No. 15/683,590, filed on Aug. 22, 2017, now Pat. No. 10,145,649.

(60) Provisional application No. 62/378,648, filed on Aug. 23, 2016.

(56) References Cited

U.S. PATENT DOCUMENTS

| | | | | | |
|---|---|---|---|---|---|
| 4,971,236 | A * | 11/1990 | Grummet | F41C 33/041 | D3/222 |
| 5,573,157 | A * | 11/1996 | Mauriello | F41C 33/0263 | 224/244 |
| 5,810,221 | A * | 9/1998 | Beletsky | F41C 33/0227 | 224/244 |
| 6,276,581 | B1 * | 8/2001 | Glock | F41C 33/0263 | 224/244 |
| 6,752,300 | B2 * | 6/2004 | Har-Shen | F41C 33/0263 | 224/244 |
| 2002/0158095 | A1 * | 10/2002 | Vor Keller | F41A 23/18 | 224/244 |
| 2004/0050887 | A1 * | 3/2004 | Spielberger | F41C 33/0245 | 224/244 |
| 2004/0195282 | A1 * | 10/2004 | Beletsky | F41C 33/0209 | 224/244 |
| 2006/0226185 | A1 * | 10/2006 | Har-Shen | F41C 33/0209 | 224/244 |
| 2016/0116253 | A1 * | 4/2016 | Moon | F41C 33/029 | 224/244 |
| 2020/0049452 | A1 * | 2/2020 | Yeates | F41C 33/0263 | |
| 2020/0200508 | A1 * | 6/2020 | Teetzel | F41G 1/36 | |
| 2022/0128332 | A1 * | 4/2022 | Yeates | F41C 33/0263 | |

* cited by examiner

HOLSTER WITH PUSHROD EJECTION PORT LOCKING ELEMENT

CROSS-REFERENCE TO RELATED APPLICATIONS

This patent application is a continuation-in-part of U.S. patent application Ser. No. 16/876,461, filed May 18, 2020, which is a continuation of U.S. patent application Ser. No. 16/209,824, filed Dec. 4, 2018, and a continuation-in-part of U.S. patent application Ser. No. 15/683,590, filed Aug. 22, 2017, and U.S. Patent Application Ser. No. 62/378,648, filed Aug. 23, 2016, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

1. Field of the Present Disclosure

The present disclosure relates generally to the field of holsters. More specifically, the presently disclosed systems, methods, and/or apparatuses relate to a locking holster adaptable to be used with a handgun or other firearm.

2. Description of Related Art

It is generally known to carry a handgun in a holster designed to protect the handgun and hold it securely. Holsters can be worn in a number of ways, such as on a belt at the waist, on the thigh, attached or coupled to a plate carrier or tactical vest, under an arm, or around an ankle.

In certain instances, a handgun must be secured or retained within the holster, but quickly and easily removed from the holster, regardless of the type of holster used. Additionally, users need to be assured that, when not in use, the handgun will remain safely in the holster.

Some holsters rely solely on friction to secure the handgun in place. This combination might not be suitable for situations where the gun/holster is subject to a great deal of movement because such movement could cause the handgun to lose frictional engagement with the holster.

Certain other holsters include a variety of strap or flap arrangements that prevent the removal of the firearm from the holster while the strap or flap is in place. With designs that rely on this method to retain a handgun, a user must first unfasten and/or rotate the strap/flap before the firearm can be withdrawn. Then, to re-secure the handgun in the holster once the handgun has been re-holstered, the user must physically refasten and/or rotate the strap/flap before the firearm is securely retained within the holster. Some users might not prefer these designs because of the time required to release and/or re-secure the handgun.

Still other types of holsters include a release lever that is pivotably attached or coupled to the holster body so as to pivot, about a pivot pin or fulcrum point, between a retention position, wherein a protrusion from the release lever is capable of engaging a portion of the handguns trigger guard, and a release position, wherein the release lever is pivoted such that the protrusion is removed from the portion of the handguns trigger guard, to allow the handgun to be withdrawn from the holster.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical holster arrangements have various shortcomings.

In order to overcome the shortcomings of the currently known holster arrangements and/or to provide an improved holster, in various exemplary, non-limiting embodiments, the holster of the presently disclosed systems, methods, and/or apparatuses comprises an at least partially locking element having at least one helix or helical protrusion that extends from at least a portion of the surface of the locking element. Alternatively, the locking element includes a helix or helical recess formed in at least a portion of the surface of the locking element.

In various exemplary, non-limiting embodiments, the holster of the presently disclosed systems, methods, and/or apparatuses comprise at least some of a holster body defining an at least partial holster cavity; a locking element, wherein the locking element extends from a rotation portion to a locking engagement portion, wherein the rotation portion includes a helical portion formed in or around at least a portion of the rotation portion, wherein the locking element includes a locking element pivot pin aperture formed through the rotation portion, wherein the locking engagement portion includes a handgun locking portion, wherein the locking element is pivotably attached or coupled to the holster body, via a locking element pivot pin positioned through at least a portion of the locking element pivot pin aperture and is repeatably rotatable between a locking element retention position and a locking element release position, wherein the locking element is biased to the locking element retention position, wherein in the locking element retention position at least a portion of handgun locking portion extends into the at least partial holster cavity to interact with a surface of an ejection port of inserted handgun, and wherein in the locking element release position the handgun locking portion is withdrawn from the at least partial holster cavity so as not to interact with a surface of the ejection port; and a pushrod, wherein the pushrod extends from a first end to a second end, wherein a release lever is attached or coupled to the second end of the pushrod such that the pushrod extends from the release lever, wherein at least a portion of the pushrod is slidably positioned within at least a portion of the holster body such that the pushrod and the release lever are repeatably slidable between a release lever retention position and a release lever release position, wherein the release lever is biased to the release lever retention position, wherein in the release lever release position interaction between the first end of the pushrod and the helical portion causes the locking element to rotate, about the rotation pin, to the locking element release position, wherein in the release lever retention position the first end of the pushrod does not make sufficient contact with the helical portion to rotate the locking element from the locking element retention position.

In various exemplary, non-limiting embodiments, the locking element is substantially arcuate in overall shape.

In various exemplary, non-limiting embodiments, the helical portion begins at or proximate a proximal end of the rotation portion and extends to at least a portion of a distal end of the rotation portion.

In various exemplary, non-limiting embodiments, the helical portion comprises a helix or helical protrusion extending from at least a portion of the surface of the rotation portion.

In various exemplary, non-limiting embodiments, the helical portion comprises a helix or helical recess extending from at least a portion of the surface of the rotation portion.

In various exemplary, non-limiting embodiments, the handgun locking portion is formed of a protrusion on the locking element.

In various exemplary, non-limiting embodiments, the handgun locking portion includes a ramp portion.

In various exemplary, non-limiting embodiments, the at least partial at least partial holster cavity includes a holster slide portion and a holster trigger guard portion.

In various exemplary, non-limiting embodiments, the handgun locking portion includes a substantially planar portion having a substantially planar surface formed so as to extend into at least a portion of the ejection port of the inserted handgun and engage the surface of the ejection port.

In various exemplary, non-limiting embodiments, the rotation portion comprises a substantially cylindrical portion.

In various exemplary, non-limiting embodiments, if the locking element is in the locking element retention position, at least a portion of the handgun locking portion extends through an aperture in a wall portion of the holster body and protrudes into a portion of the at least partial holster cavity.

In various exemplary, non-limiting embodiments, the holster of the present disclosure comprises at least some of a holster body defining an at least partial holster cavity; a locking element, wherein the locking element extends from a rotation portion to a locking engagement portion, wherein the rotation portion includes a helical portion formed in or around at least a portion of the rotation portion, wherein the locking element includes a locking element pivot pin aperture formed through the rotation portion, wherein the locking engagement portion includes a handgun locking portion, wherein the locking element is pivotably attached or coupled to the holster body, via a locking element pivot pin positioned through at least a portion of the locking element pivot pin aperture and is repeatably rotatable between a locking element retention position and a locking element release position, wherein in the locking element retention position at least a portion of handgun locking portion extends into at least a portion of the at least partial holster cavity so as not to interact with a surface of an ejection port if the inserted handgun, and wherein in the locking element release position the handgun locking portion is at least partially withdrawn from at least a portion of the at least partial holster cavity so as not to interact with the surface of the ejection port; and a pushrod, wherein the pushrod extends from a first end to a second end, wherein a release lever is attached or coupled to the second end of the pushrod such that the pushrod extends from the release lever, wherein at least a portion of the pushrod is slidably positioned within at least a portion of the holster body such that the pushrod and the release lever are repeatably slidable between a release lever retention position and a release lever release position, wherein in the release lever release position interaction between the first end of the pushrod and the helical portion causes the locking element to rotate, about the rotation pin, to the locking element release position, wherein in the release lever retention position the first end of the pushrod does not make sufficient contact with the helical portion to rotate the locking element from the locking element retention position.

In various exemplary, non-limiting embodiments, the locking element is substantially arcuate in overall shape.

In various exemplary, non-limiting embodiments, the locking element is biased to the locking element retention position.

In various exemplary, non-limiting embodiments, the release lever is biased to the release lever retention position.

In various exemplary, non-limiting embodiments, the handgun locking portion is formed of a protrusion on the locking element.

In various exemplary, non-limiting embodiments, the rotation portion comprises a substantially cylindrical portion.

In various exemplary, non-limiting embodiments, if the locking element is in the locking element retention position, at least a portion of the handgun locking portion extends through an aperture in a wall portion of the holster body and protrudes into a portion of the at least partial holster cavity.

In various exemplary, non-limiting embodiments, the locking element includes a locking element pivot pin aperture formed through the rotation portion, and wherein the locking element is pivotably attached or coupled to the holster body, via a locking element pivot pin positioned through at least a portion of the locking element pivot pin aperture.

In various exemplary, non-limiting embodiments, the holster of the present disclosure comprises at least some of a holster body defining an at least partial holster cavity; a locking element extending from a rotation portion to a locking engagement portion, the rotation portion comprising a substantially cylindrical portion and including a helical portion formed in or around at least a portion of the rotation portion, the locking engagement portion including a handgun locking portion, the locking element being pivotably attached or coupled to the holster body and repeatably rotatable between a locking element retention position and a locking element release position, in the locking element retention position at least a portion of handgun locking portion extends into at least a portion of the at least partial holster cavity; and a pushrod extending from a first end to a second end and having a release lever attached or coupled to the second end such that the pushrod extends from the release lever, at least a portion of the pushrod being slidably positioned within at least a portion of the holster body such that the pushrod and the release lever are repeatably slidable between a release lever retention position and a release lever release position such that if the pushrod is urged to the release lever release position, interaction between the first end of the pushrod and the helical portion causes the locking element to rotate toward the locking element release position.

Accordingly, the holster of the present disclosure separately and optionally provides a quick-release handgun holster.

The holster of the present disclosure separately and optionally provides a handgun holster, which is capable of retaining a handgun securely in the holster while permitting a release of the handgun when the user requires.

The holster of the present disclosure separately and optionally provides a handgun holster, which is simple to operate.

The holster of the present disclosure separately and optionally provides a handgun holster, which secures the handgun in the holster upon seating of the handgun in the holster, without requiring any additional operation by the user.

The presently disclosed systems, methods, and/or apparatuses separately and optionally provide a holster that can be easily manipulated by a user.

The holster of the present disclosure separately and optionally provides a handgun holster, which utilizes a firearm locking portion to engage at least a portion of an ejection port of an inserted handgun.

The presently disclosed systems, methods, and/or apparatuses separately and optionally provide a holster that can be easily manipulated by a user.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses of the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
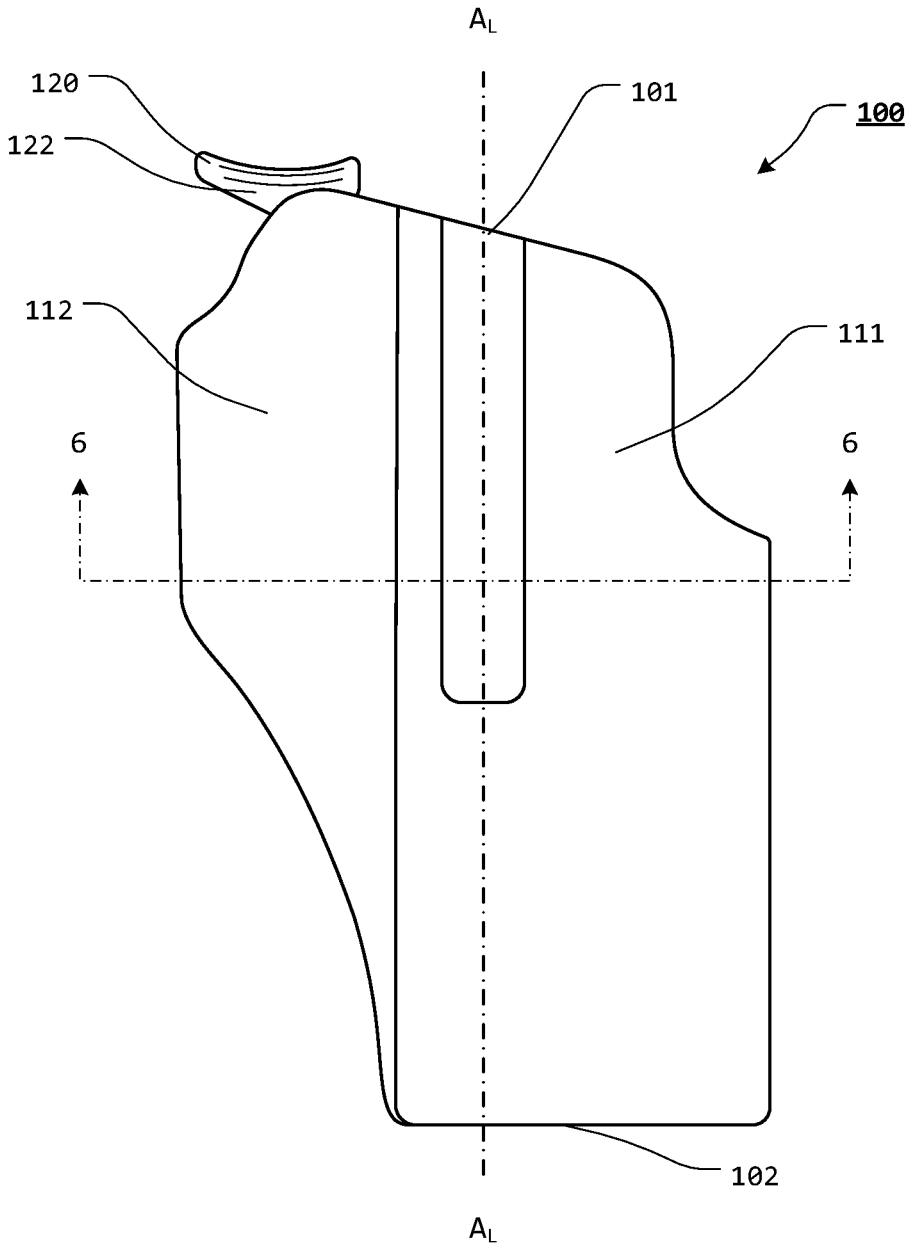
FIG. 1 illustrates a right side view of an exemplary embodiment of a holster, according to the presently disclosed systems, methods, and/or apparatuses.
Figure 2:
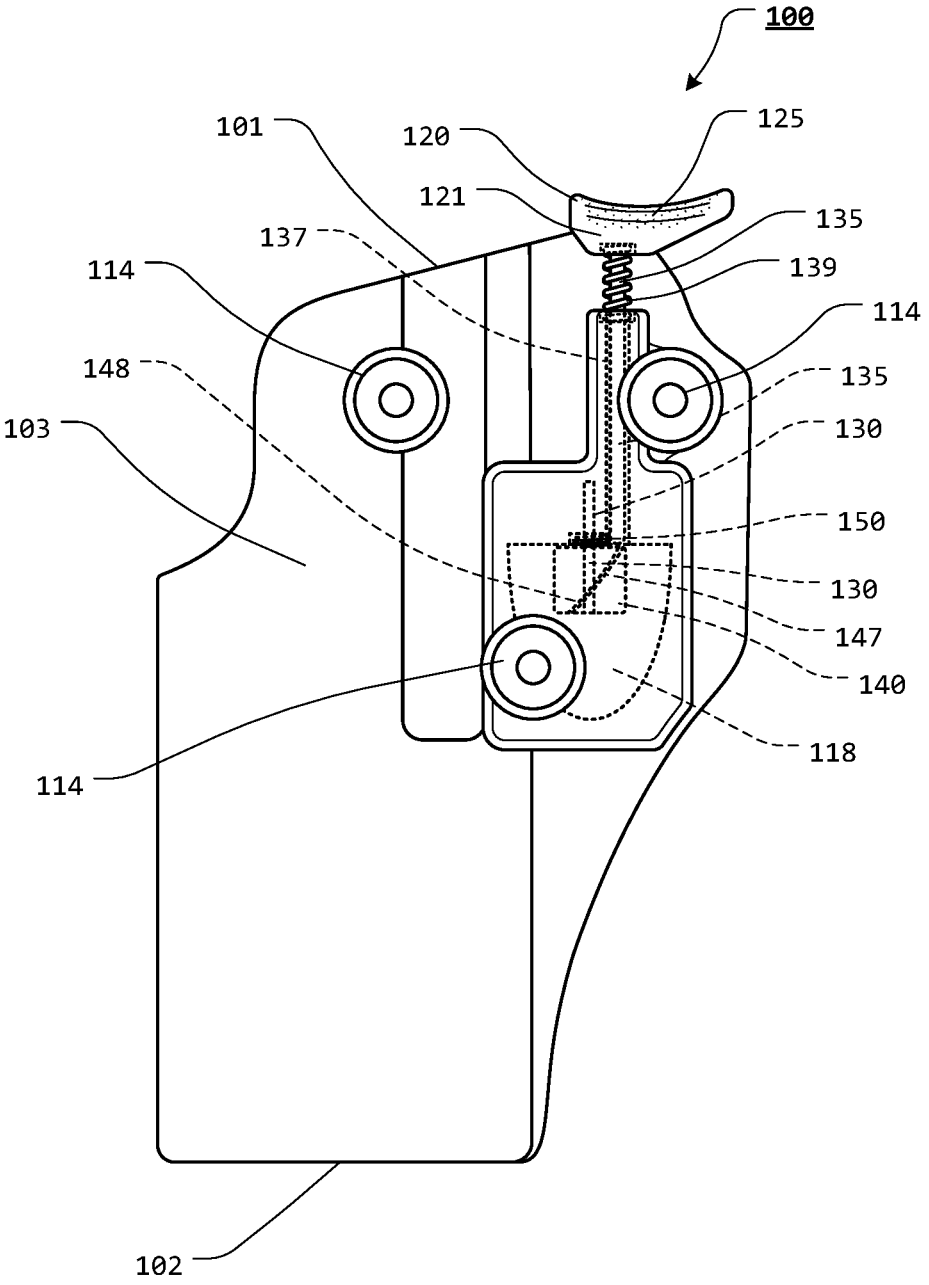
FIG. 2 illustrates a left side view of an exemplary embodiment of a holster, in a retention position, according to the presently disclosed systems, methods, and/or apparatuses.

For simplicity and clarification, the design factors and operating principles of the holster according to the presently disclosed systems, methods, and/or apparatuses are explained with reference to various exemplary embodiments of a holster according to the presently disclosed systems, methods, and/or apparatuses. The basic explanation of the design factors and operating principles of the holster is applicable for the understanding, design, and operation of the holster of the presently disclosed systems, methods, and/or apparatuses. It should be appreciated that the holster can be adapted to many applications where a holster can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as attached or coupled, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "handgun" and "holster" are used for a basic explanation and understanding of the operation of the systems, methods, and apparatuses of this invention. Therefore, the terms "handgun" and "holster" are not to be construed as limiting the systems, methods, and apparatuses of this invention.

Furthermore, it should be appreciated that, for simplicity and clarification, the embodiments of this invention will be described with reference to a semiautomatic-type handgun being secured within the holster of the present disclosure. However, it should be appreciated that the operating principles of the disclosed holster may also be employed to construct holsters or holders for any revolver or semiautomatic-type handgun, edged handguns as well as less than lethal products (i.e., tasers, pepper spray, mace canisters, or batons), so long as these items have an appropriate ledge or void that may be engaged or retained by a locking projection or other retaining means. Furthermore, it is also within the scope of the present invention that the present holster may be employed as a pouch for tactical accessories, such as ammunition magazines and/or flashlights, as well as for everyday items such as cell phones or personal digital assistants.

Turning now to the appended drawing figures, FIGS. 1-12 illustrate certain elements and/or aspects of a holster 100 according to this invention. It should be appreciated that the holster 100 is adapted to retain an exemplary semiautomatic-type handgun 180. The semiautomatic-type handgun 180 generally includes a slide portion 183 and a frame portion 185. The slide portion 183 generally includes a barrel, while the frame portion 185 generally includes a dust cover, a grip, a trigger guard 186, and a trigger. The trigger guard 186 includes an outer surface 187, which defines the outer perimeter of the trigger guard 186 and an inner surface 188, which defines an area where the trigger is located and allows a user's finger access to the trigger.

An ejection port 184 is formed in a portion of the slide portion 183.

In illustrative, non-limiting embodiments of the presently disclosed systems, methods, and/or apparatuses, as illustrated in FIGS. 1-12, the illustrated, exemplary holster 100 includes a holster body 103 defining an at least partial holster cavity portion 104 for receiving and holding the handgun 180. The holster body 103 comprises a pair of opposed wall portions comprising a first wall portion 106 and a second wall portion 107 and a pair of opposed wall portions comprising a third wall portion 108 and a fourth wall portion 109. Typically, the first wall portion 106 is considered the inner side of the holster 100 and is worn against or adjacent the user's body, while the second wall portion 107 is considered the outer side of the holster 100 and is worn away from the user's body. The third wall portion 108 and the fourth wall portion 109 form additional side wall portions of the holster 100 and may be included to assist in maintaining at least portions of the handgun 180 within at least a portion of the holster body 103.

However, it should be appreciated that the holster 100 may be formed such that one or more of the first wall portion 106, the second wall portion 107, the third wall portion 108, and/or the fourth wall portion 109 is/are sufficient to define the at least partial holster cavity portion 104 for receiving the handgun 180 and the remaining wall portions are not included.

The at least partial holster cavity portion 104 includes a holster frame top portion 101 and a holster frame bottom portion 102 and may be formed from any number or combination of wall portions, including, for example, a single, continuous wall portion or multiple coupled or joined wall portions. Thus, the at least partial holster cavity portion 104 may be formed by any cavity, partial cavity, space, or platform that is capable of retaining a handgun 180.

In certain exemplary, nonlimiting embodiments, the holster body 103 merely comprises a single wall portion, such as, for example, the first wall portion 106. Any remaining portions of the holster 100 may be attached, coupled, or formed as a portion or extension of the first wall portion 106 and/or the holster body 103.

In certain exemplary, nonlimiting embodiments, as illustrated, the holster body 103 and/or the at least partial holster cavity portion 104 includes a holster slide portion 111 and a holster trigger guard portion 112. At least a portion of the holster trigger guard portion 112 is shaped to receive and accommodate at least a portion of the trigger guard 186 of an inserted handgun 180. In various exemplary embodiments, the holster trigger guard portion 112 is generally formed by a portion of the body of the holster 100. The holster trigger guard portion 112 is shaped generally to match the contours of at least a portion of the outer surface 187 of the trigger guard 186. The holster trigger guard portion 112 is formed to contact at least a portion of the outer surface 187 of the trigger guard 186 of the inserted handgun 180 and further limit how far the handgun 180 can be inserted into the holster 100.

The construction of the holster 100 further facilitates alignment of the trigger guard 186 with the locking projection portion 146 by limiting lateral movement of the handgun 180 with respect to the release lever 120 and the locking projection portion 146 without preventing a user from easily holstering or drawing the handgun 180.

It should be noted that the wall portions of the holster 100 may generally be planar. Alternatively, the wall portions of the holster 100 may be contoured or shaped to better accommodate a specific type or model of handgun 180 to be retained within the holster 100.

In various exemplary embodiments, the holster 100 optionally includes at least one holster frame attachment portion 114, which provides one or more areas, portions, or devices for fastening the holster 100 to a holster holding device. Alternatively, the means for holster frame attachment portion 114 may comprise a clip or hook adapted to, for example, be clipped over or to a belt. In further exemplary embodiments, the holster frame attachment portion 114 may comprise one or more quick-disconnect or other couplings, which may be permanently or removably coupled to corresponding and cooperating coupling(s) provided on a belt or other carrier or platform. In still other exemplary embodiments, the holster 100 may comprise an integral belt, or may comprise one or more connections for attachment to a chest, ankle, leg, shoulder, or other harness or band, or for otherwise securing the holster 100 to a user or the user's apparel.

In various exemplary embodiments, the holster 100 is substantially rigid and is formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, woven fiber, natural materials, such as, for example, leather, and/or various combinations of the foregoing.

Thus, it should be understood that the material or materials used to form the holster 100 and/or various components of the holster 100 is a design choice based on the desired appearance and functionality of the holster 100.

As further shown in FIGS. 1-12, the holster 100 comprises a locking element 140. The locking element 140 is capable of operating to retain a handgun 180 securely in the holster 100 by restricting withdrawal of the handgun 180 from the at least partial holster cavity portion 104 of the holster 100 when in a retention position, while permitting a release of the handgun 180 when in a release position.

In various exemplary, nonlimiting embodiments, the locking element 140 comprises a substantially cylindrical portion of material extending from a proximal end 141 to a distal end 142 and having a first helical portion 145 formed in or around at least a portion of the locking element 140 and a second helical portion 147 formed in or around at least a portion of the locking element 140. In certain alternative embodiments, the locking element 140 may have an overall cylindrical or conical shape. Thus, the locking element 140 may have a substantially consistent diameter, an increasing diameter, or a decreasing diameter from the proximal end 141 to the distal end 142.

The first helical portion 145 begins at or proximate the proximal end 141 and extends to a locking projection portion 146 extending from at least a portion of the distal end 142 of the locking element 140.

In various exemplary embodiments, the locking element 140 includes a helix or helical protrusion or first helical portion 145 that extends from at least a portion of the surface of the locking element 140, forming a helically threaded portion. Alternatively, the locking element 140 includes a helix or helical recess formed in at least a portion of the surface of the locking element 140. Whether a protrusion or recess, the first helical portion 145 provides a first helical ramp surface 144 or incurved rim that curves around at least a portion of the locking element 140. In certain exemplary embodiments, the first helical portion 145 or first helical ramp surface 144 generally follows a spiral or a curve along a portion of the locking element 140 that can be defined by the rotation of a point crossing cross-sections (taken perpendicular to the longitudinal axis of the locking element 140) of the first helical portion 145, at a consistent, oblique angle.

Figure 13:
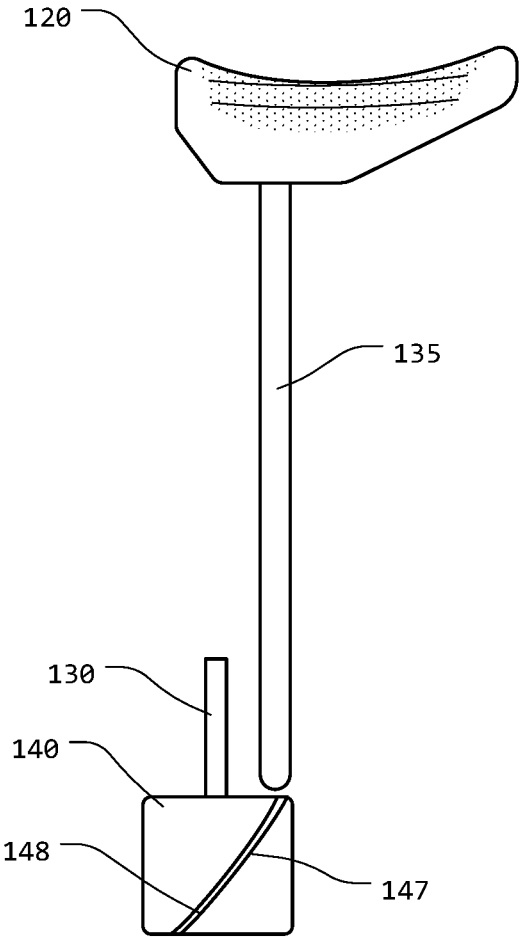
FIG. 13 illustrates a left side view of an exemplary embodiment of a pushrod and locking element, according to the presently disclosed systems, methods, and/or apparatuses.

As illustrated, for example, in FIG. 13, second helical portion 147 begins at or proximate the proximal end 141 (generally on an opposing side of the locking element 140 from the beginning of the first helical portion 145) and extends toward or to the distal end 142 of the locking element 140.

In various exemplary embodiments, the locking element 140 includes a helix or helical protrusion or second helical portion 147 that extends from at least a portion of the surface of the locking element 140, forming a helically threaded portion. Alternatively, the locking element 140 includes a helix or helical recess formed in at least a portion of the surface of the locking element 140. Whether a protrusion or recess, the second helical portion 147 provides a second helical ramp surface 148 or incurved rim that curves around at least a portion of the locking element 140. In certain exemplary embodiments, the second helical portion 147 or second helical ramp surface 148 generally follows a spiral or a curve along a portion of the locking element 140 that can be defined by the rotation of a point crossing cross-sections (taken perpendicular to the longitudinal axis of the locking element 140) of the second helical portion 147, at a consistent, oblique angle.

In various exemplary embodiments, the first helical portion 145 (including the first helical ramp surface 144) and the second helical portion 147 (including the second helical ramp surface 148) are formed as a single, continuous, helical ramp surface. Thus, the locking element 140 may include a single helical portion having a single helical ramp surface or a double helical portion including a first helical portion with a first helical ramp surface and a second helical portion with a second helical ramp surface.

The locking element 140 is attached or coupled at or proximate the proximal end 141 of a rotation pin 130, which extends from a portion of the holster body 103. In certain exemplary embodiments, the locking element 140 is attached or coupled to a terminal end of the rotation pin 130. In certain other exemplary embodiments, the locking element 140 is at least partially attached or coupled to the rotation pin 130 via a locking element securing element 160.

In various exemplary embodiments, the locking element 140 is attached or coupled to the rotation pin 130 at a cross-sectional center of the locking element 140. Alternatively, the locking element 140 is attached or coupled to the rotation pin 130 at a point that is offset from the cross-sectional center of the locking element 140. Thus, the locking element 140 may be rotated by the rotation pin 130 in a substantially consistent or offset manner.

In certain exemplary, nonlimiting embodiments, the rotation pin 130 comprises a separate portion of material extending out of or from the holster body 103. Alternatively, the rotation pin 130 may optionally comprise an extension of material used to form at least a portion of the holster body 130. Thus, the rotation pin 130 may comprise a separate element or an integral component that extends from the holster body 130.

In various exemplary embodiments, the locking element 140 may optionally be biased to the retention position, whether a handgun 180 is present in the holster 100 or absent from the holster 100. In various exemplary embodiments, biasing of the locking element 140 may be accomplished by, for example, a locking element biasing element 150 secured between at least a portion of the holster body 103 and at least a portion of the locking element 140. In various exemplary embodiments, the locking element 140 includes a biasing element receiving groove 149 formed in the locking element 140 that engages an end portion of the locking element biasing element 150. The locking element biasing element 150 may comprise a coil or other spring or any suitable spring mechanism or resilient element.

The locking element 140 is rotatable within at least a portion of the holster trigger guard portion 112. In certain exemplary, nonlimiting embodiments, the locking element 140 is positioned at least partially within a holster recess 118 formed to allow the locking element 140 to rotate freely without contact or interaction from external objects are forces on a side opposite the holster recess 118.

A pushrod channel 137 is formed in or through at least a portion of the holster body 103. In various exemplary embodiments, the pushrod channel 137 is formed through the material forming the holster body 103. Alternatively, the pushrod channel 137 is formed to include an at least partial pushrod channel 137 insulator or other material. If included, the insulator or other material aids in the smooth slidable movement of at least a portion of the pushrod 135 within the pushrod channel 137. The pushrod channel 137 is formed to have an inner diameter that allows at least a portion of the pushrod 135 to be fitted within the pushrod channel 137 and substantially freely slide, in a lateral fashion, within the pushrod channel 137.

Generally, the pushrod channel 137 is formed proximate the holster trigger guard portion 112, such that when the pushrod 135 is slidably inserted within the pushrod channel 137, at least a first end portion of the pushrod 135 may extend within a holster recess 118 to contact the second helical ramp surface 148 of the second helical portion 147 of the locking element 140.

In various exemplary embodiments, the pushrod channel 137 is positioned substantially parallel to a longitudinal axis, $A_L$, of the holster 100, substantially perpendicular to a longitudinal axis of the holster 100, at a substantially acute angle relative to a longitudinal axis of the holster 100, or at a substantially obtuse angle relative to a longitudinal axis of the holster 100. Thus, the pushrod channel 137 may be positioned at any angle relative to either a longitudinal axis, $A_L$, or other axis of the holster 100.

A release lever 120 is attached or coupled at a second end or proximate a second end of the pushrod 135. The pushrod 135 generally comprises an elongate portion of material extending from a first end to a second end. In various exemplary embodiments, the pushrod 135 has a substantially circular cross-section. Alternatively, the pushrod 135 may have a substantially ovular, triangular, square, octagonal, or other desired cross-section.

In certain exemplary embodiments, the release lever 120 is attached or coupled to a terminal second end of the pushrod 135. The release lever 120 includes a release lever first side 121 facing generally outward from the holster 100, away from the at least partial holster cavity portion 104, and a release lever second side 122 facing generally toward the at least partial holster cavity portion 104.

In various exemplary embodiments, the release lever first side 121 of the release lever 120 includes a textured portion 125. In this manner, the release lever first side 121 of the release lever 120 may be distinguished tactilely from other portions of the release lever 120 or the holster 100.

Figure 3:
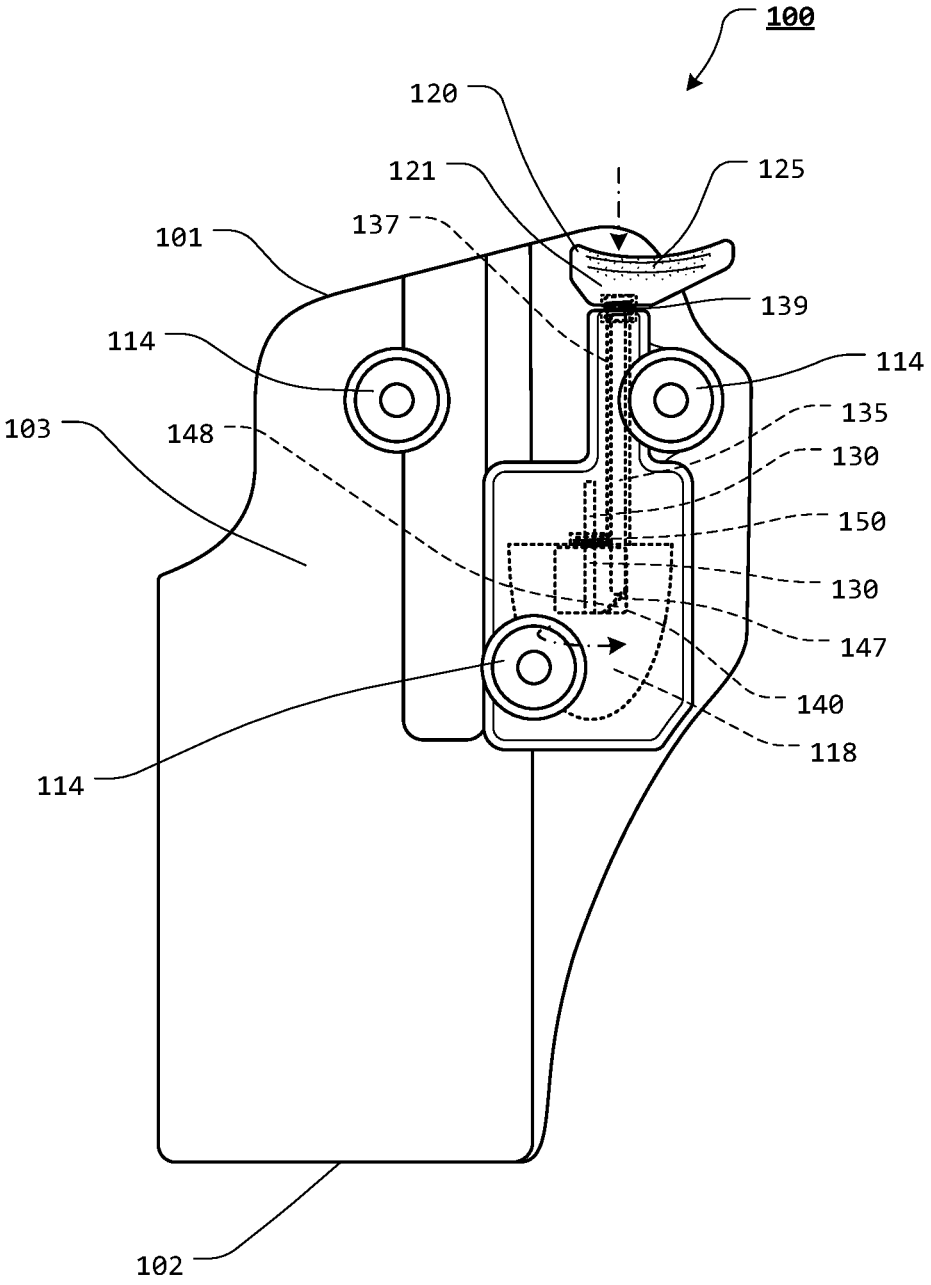
FIG. 3 illustrates a left side view of an exemplary embodiment of a holster, in a release position, according to the presently disclosed systems, methods, and/or apparatuses.
Figure 4:
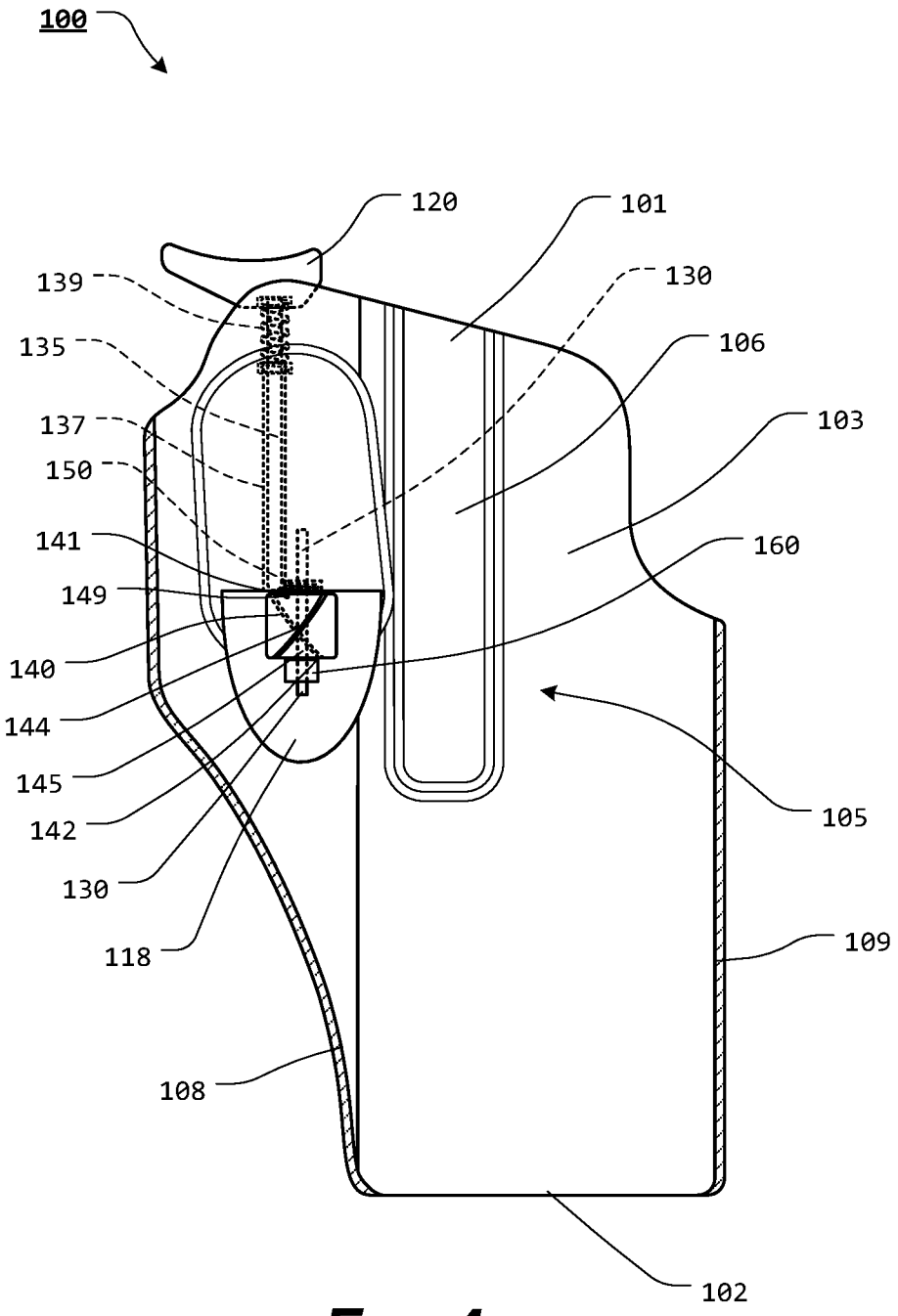
FIG. 4 illustrates a right side, cross-sectional view of an exemplary embodiment of a holster, in a retention position, according to the presently disclosed systems, methods, and/or apparatuses.
Figure 12:
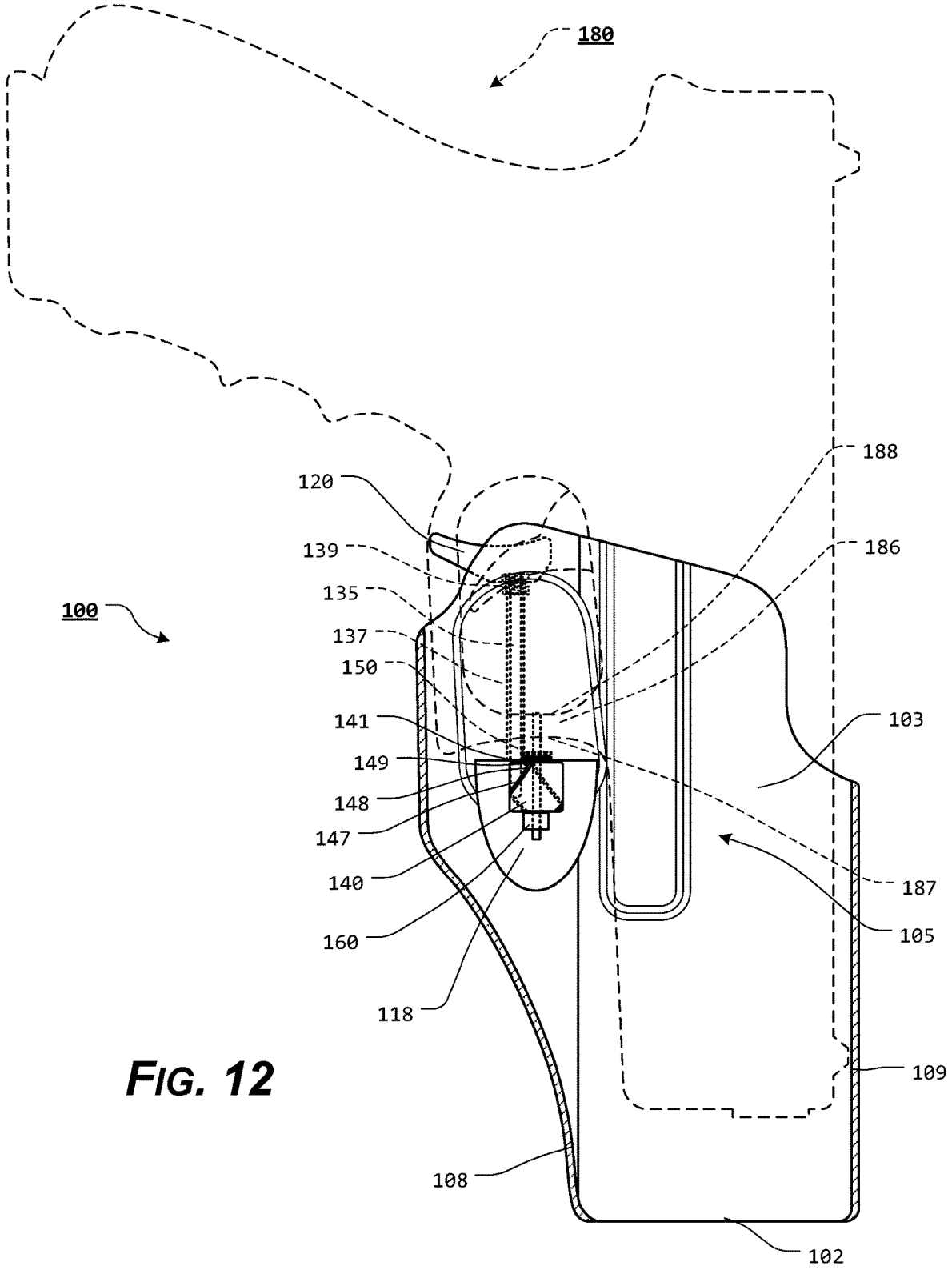
FIG. 12 illustrates a right side, cross-sectional view of an exemplary embodiment of a holster, wherein the locking element is rotated to a release position and an exemplary handgun is partially withdrawn from the holster, according to the presently disclosed systems, methods, and/or apparatuses.

The release lever 120 is slidable, via the locking element pivot pin 130, between a release position, as illustrated most clearly in FIGS. 1, 2, 4-6, and 9 and a retention position, as illustrated in FIGS. 3 and 12. In the release position, the first end of the pushrod 135 optionally does not make sufficient contact with the second helical portion 147 or the second helical ramp surface 148 of the locking element 140 to cause the locking element 140 to rotate toward the disengaged or release position. As the release lever 120 is urged downward, toward the locking element 140, the first end of the pushrod 135 contacts the second helical portion 147 and/or the second helical ramp surface 148. As the release lever 120 (and the pushrod 135) continue to be urged toward the locking element 140, interaction between the first end of the pushrod 135 and the second helical ramp surface 148 of the second helical portion 147 causes the locking element 140 to rotate, about the rotation pin 130.

Thus, when the pushrod 135 is slidably positioned within the pushrod channel 137, linear manipulation of the release lever 120 (movement either toward or away from the locking element 140), results in rotation of the locking element 140. Thus, the locking element 140 can be at least partially rotated relative to the holster trigger guard portion 112.

In various exemplary embodiments, the release lever 120 (and the pushrod 135) may optionally be biased to the release position, whether a handgun 180 is present in the holster 100 or absent from the holster 100. In various exemplary embodiments, biasing of the release lever 120 (and the pushrod 135) may be accomplished by, for example, a release lever biasing element 139 secured between at least a portion of the holster body 103 and at least a portion of the release lever 120. In various exemplary embodiments, the release lever biasing element 139 may comprise a coil or other spring or any suitable spring mechanism or resilient element.

When a handgun 180 is seated within the holster 100 and the locking element 140 is in the retention position, at least a locking projection portion 146 of the locking element 140 extends from the holster recess 118 a sufficient distance to protrude within the trigger guard 186 and potentially contact at least an inner surface 188 of the trigger guard 186. When the locking element 140 is in the release position, the locking projection portion 146 is retracted into the holster recess 118 a sufficient distance to allow at least an inner surface 188 of the trigger guard 186 to pass by the locking projection portion 146.

While the locking projection portion 146 is primarily shown and described as being positioned so that the locking projection portion 146 may extend into the at least partial holster cavity portion 104 and potentially engage an inner surface 188 of the trigger guard 186, it should be appreciated that the locking element 140 may be positioned at any portion of the holster body 103 so that the locking projection portion 146 may extend into the at least partial holster cavity portion 104 and potentially engage any surface or shoulder of the handgun 180. For example, the locking element 140 may be positioned so that the locking projection portion 146 may extend into the at least partial holster cavity portion 104 and potentially engage an ejection port of the handgun 180.

Regardless of the particular handgun 180 to be used in conjunction with the holster 100, the locking projection portion 146 should be shaped so that there is no possibility that the locking projection portion 146 can at any time contact the trigger of the handgun 180. When the handgun 180 is pushed as far forward as possible into the holster 100, a space is maintained between the locking projection portion 146 and the trigger of the handgun 180.

When the release lever 120 is in the retention position, the locking projection portion 146 protrudes to extend inside the at least a portion of the at least partial holster cavity portion 104 and inside the trigger guard 186 of a handgun 180 that is seated in the holster 100 and, thereby, resist or block withdrawing or rearward movement of the handgun 180 and retain the handgun 180 in the holster 100.

In various exemplary embodiments, the locking projection portion 146 protrudes into the at least partial holster cavity portion 104 for a distance that is less than the width of the trigger guard 186. Alternatively, the locking projection portion 146 may protrude into the at least partial holster cavity portion 104 for a distance that is equal to or greater than the width of the trigger guard 186.

Figure 14:
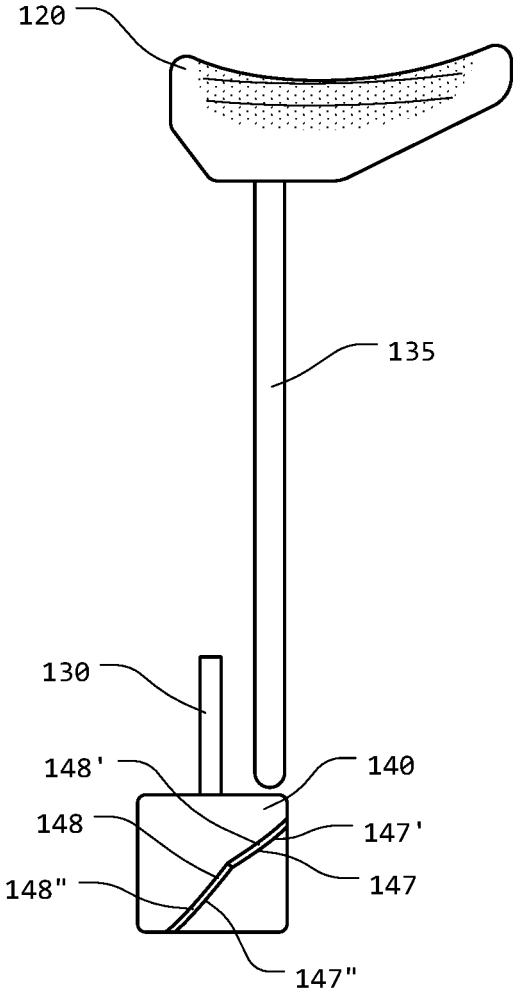
FIG. 14 illustrates a left side view of an exemplary embodiment of a pushrod and locking element, according to the presently disclosed systems, methods, and/or apparatuses.

In various exemplary embodiments, as illustrated, for example, in FIG. 14, the second helical portion 147 (including the second helical ramp surface 148) may optionally be formed as a multipart or multi-ramped surface. As illustrated, for example, the second helical portion 147 may be comprised of an initial helical portion 147' and a subsequent helical portion 147" (and an initial helical ramp surface 148' and a subsequent helical ramp surface 148"). By forming the second helical portion 147 as a multipart or multi-ramped surface, as the first end of the pushrod 135 contacts the initial helical portion 147', continuing lateral movement of the pushrod 135 (along the longitudinal axis of the pushrod 135), along the initial helical portion 147', produces a first degree of angular rotation of the locking element 140. As the pushrod 135 is urged further toward the locking element 140, the first end of the pushrod 135 transitions from contacting the initial helical portion 147' and contacts the subsequent helical portion 147". As the first end of the pushrod 135 contacts the subsequent helical portion 147", continuing lateral movement of the pushrod 135, along the subsequent helical portion 147", produces a second degree of angular rotation of the locking element 140.

While FIG. 14, illustrates the initial helical portion 147' as having a shallower pitch than the subsequent helical portion 147", it should be appreciated that this is merely illustrative and not limiting. Therefore, it should be appreciated that the initial helical portion 147' may have a pitch that is steeper than the pitch of the subsequent helical portion 147". Furthermore, the number of helical portions comprising the second helical portion 147 is a design choice. Additionally, the pitch or angle of each portion of the second helical portion 147 is also a design choice.

Thus, different or varying angular ramped or other surfaces along the locking element 140 can allow different degrees of angular rotation of the locking element, as the pushrod 135 engages different portions of the second helical portion 147 and the second helical ramp surface 148. In this manner, different levels of engagement provided by the locking element 140 can be produced, based upon the position of the first end of the pushrod 135 along the second helical portion 147. It should be appreciated that the pitch, angle, or presentation of the second helical portion 147 and the second helical ramp surface 148 is a design choice based upon the desired level of angular rotation of the locking element 140 at various positions of the pushrod 135. Therefore, alterations in the pitch, angle, or presentation of the second helical portion 147 and the second helical ramp surface 148 and alter the engagement or clearance of mating surfaces.

During use of the embodiment illustrated in FIG. 14, as the release lever 120 is urged downward, toward the locking element 140, the first end of the pushrod 135 initially contacts initial helical portion 147'. As the release lever 120 (and the pushrod 135) continue to be urged toward the locking element 140, interaction between the first end of the pushrod 135 and the initial helical portion 147' of the second helical portion 147 causes the locking element 140 to rotate about the rotation pin 130.

As the release lever 120 (and the pushrod 135) are further urged toward the locking element 140, the first end of the pushrod 135 interacts with the subsequent helical portion 147" of the second helical portion 147, causing the locking element 140 to rotate about the rotation pin 130 at a rotational rate, per distance traveled by the pushrod 135, that is greater than the rotational rate, per distance traveled by the pushrod 135, as the first end of the pushrod 135 interacts with the initial helical portion 147'. In this manner, as a user initially depresses the release lever 120, a lesser amount of downward transition of the release lever 120 is required to cause initial rotation of the locking element 140. As the user continues to depress the release lever, and the first end of the pushrod 135 transitions from the initial helical portion 147' to the subsequent helical portion 147", a greater amount of downward transition of the release lever is required to cause a similar degree of rotation of the locking element 140.

Various exemplary embodiments, first end of the pushrod 135 may optionally comprise a surface or terminal surface that corresponds to or meets with a surface of the second helical portion 147 and/or the second helical ramp surface 148.

During use of the holster 100, as illustrated in FIGS. 5-12, as the handgun 180 is inserted into the at least partial holster cavity portion 104 of the holster 100, muzzle first, the handgun 180 is guided into position by at least some portion of the holster 100, such as, for example, the first wall portion 106, the second wall portion 107, the third wall portion 108, and/or the fourth wall portion 109.

Figure 5:
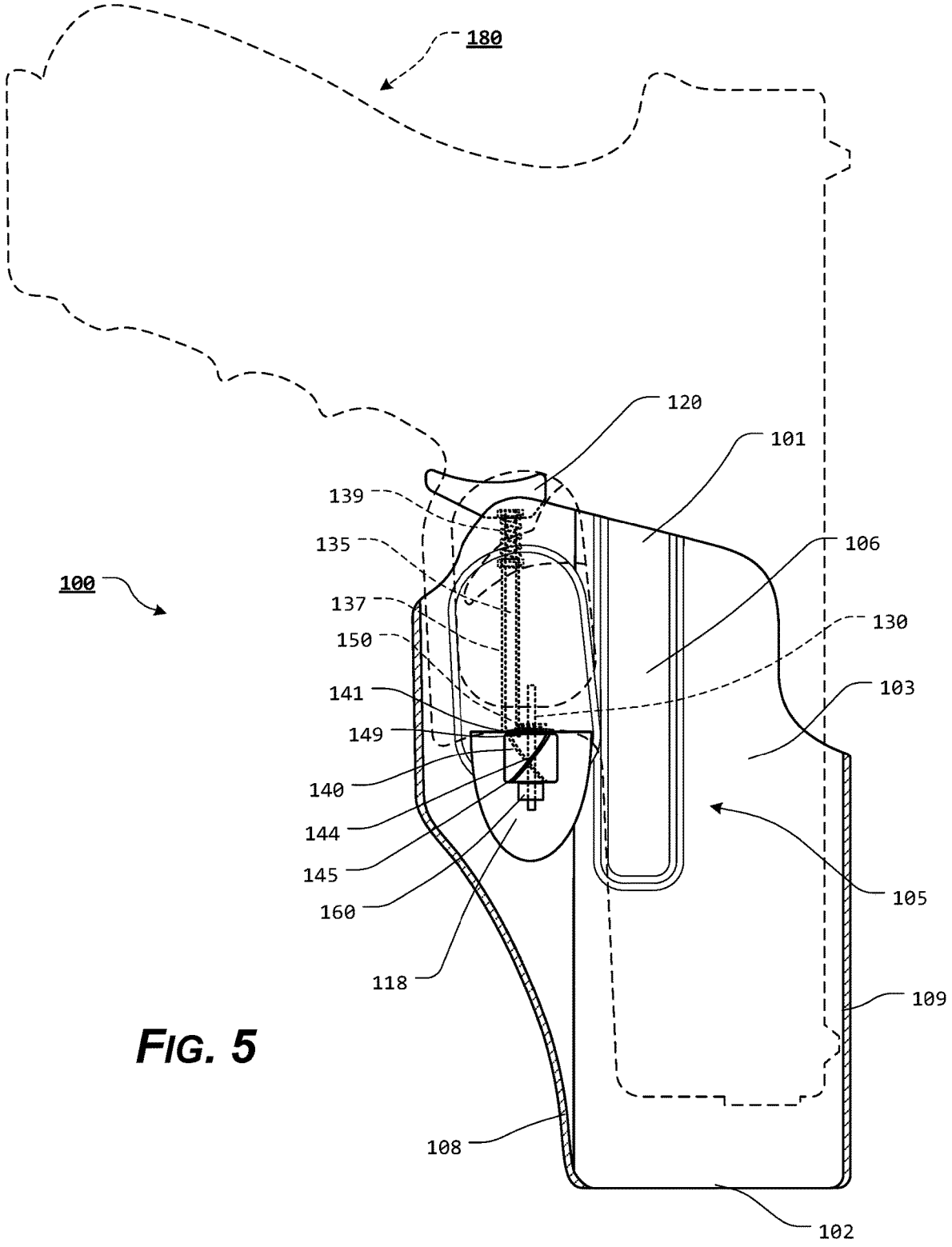
FIG. 5 illustrates a right side, cross-sectional view of an exemplary embodiment of a holster, wherein an exemplary handgun is partially inserted within the holster, according to the presently disclosed systems, methods, and/or apparatuses.
Figure 6:
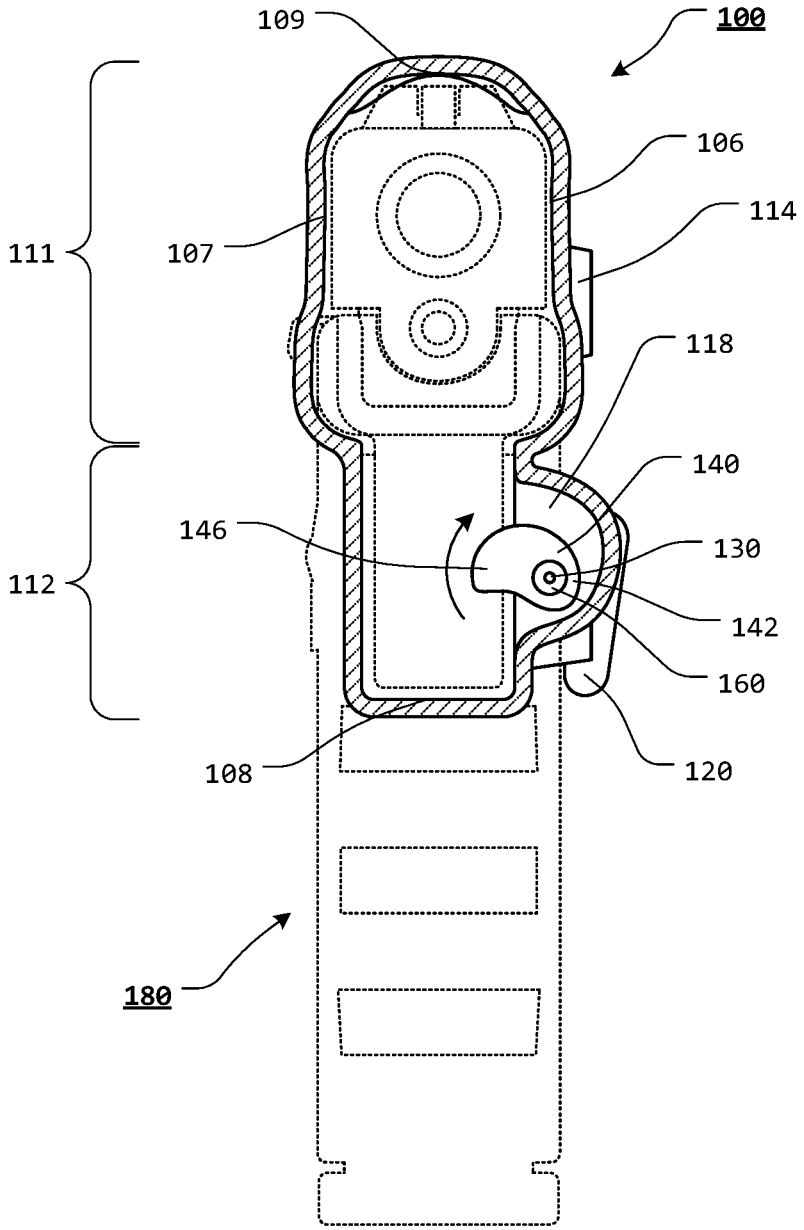
FIG. 6 illustrates a bottom, cross-sectional view, taken along line 6-6 of FIG. 1, of an exemplary embodiment of a holster, wherein an exemplary handgun is partially inserted within the holster, according to the presently disclosed systems, methods, and/or apparatuses.

As the handgun 180 is inserted further into the at least partial holster cavity portion 104, at least a portion of the trigger guard 186 will slide adjacent or against the holster trigger guard portion 112 and a portion of the outer surface 187 of the trigger guard 186 will contact the first helical portion 145 and/or the first helical ramp surface 144 of the locking element 140 proximate or at the proximal end 141 of the locking element 140, as illustrated in FIGS. 5 and 6. The shape of the first helical portion 145 and/or the first helical ramp surface 144 allows at least a portion of the first helical portion 145 to ride along the surface of the trigger guard 186 and apply a rotational force to rotate the locking element 140, about the rotation pin 130, toward the release position.

Figure 7:
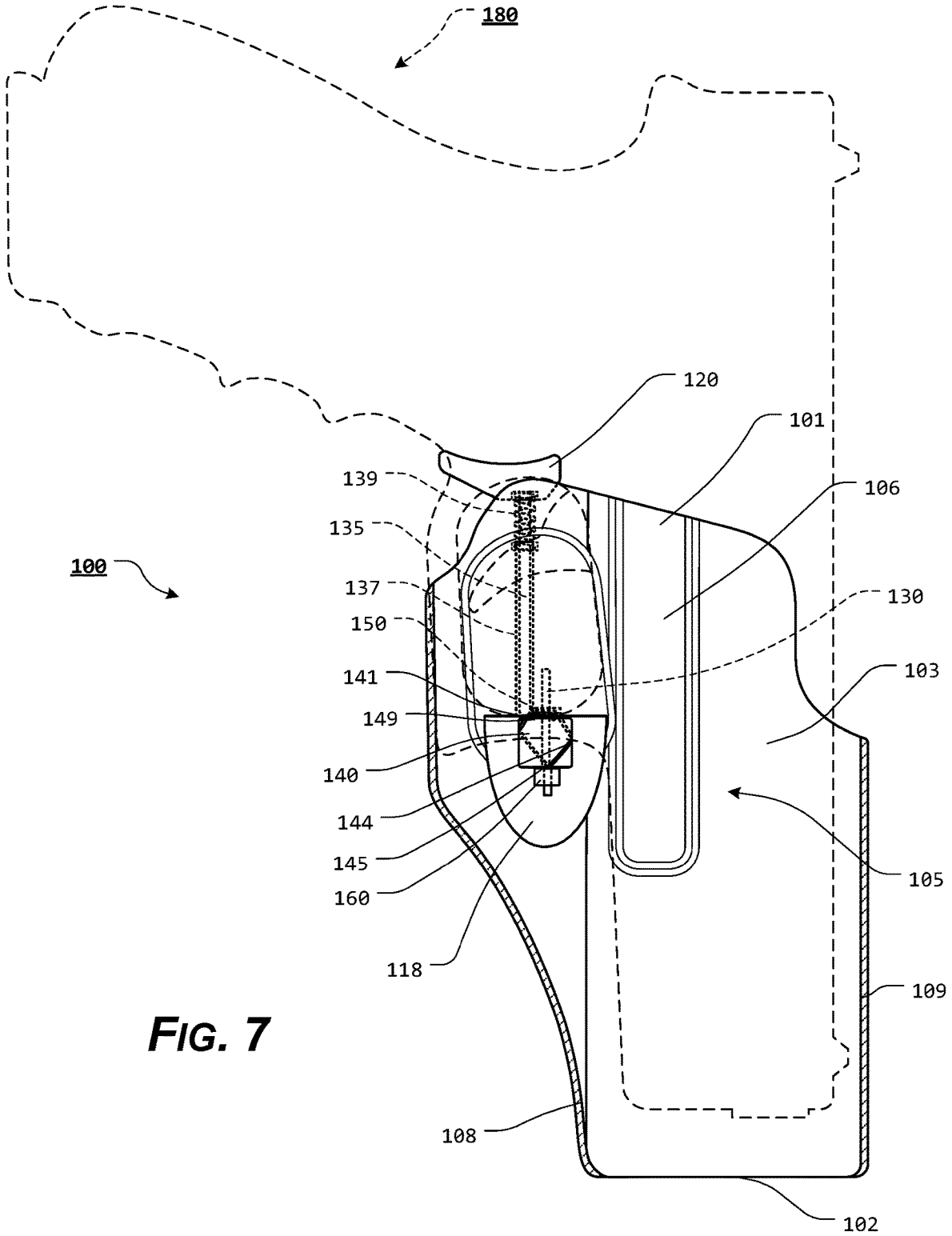
FIG. 7 illustrates a right side, cross-sectional view of an exemplary embodiment of a holster, wherein an exemplary handgun is further partially inserted within the holster, according to the presently disclosed systems, methods, and/or apparatuses.

As the first helical portion 145 continues to ride along the surface of the trigger guard 186, the bias of the locking element 140 is overcome and the locking element 140 is rotated toward the release position, as illustrated in FIG. 7, and the handgun 180 is permitted to be seated in the at least partial holster cavity portion 104 of the holster 100. The trigger guard 186 is prevented from moving in a direction opposite the locking projection portion 146 by the interior surfaces of the holster 100.

Figure 8:
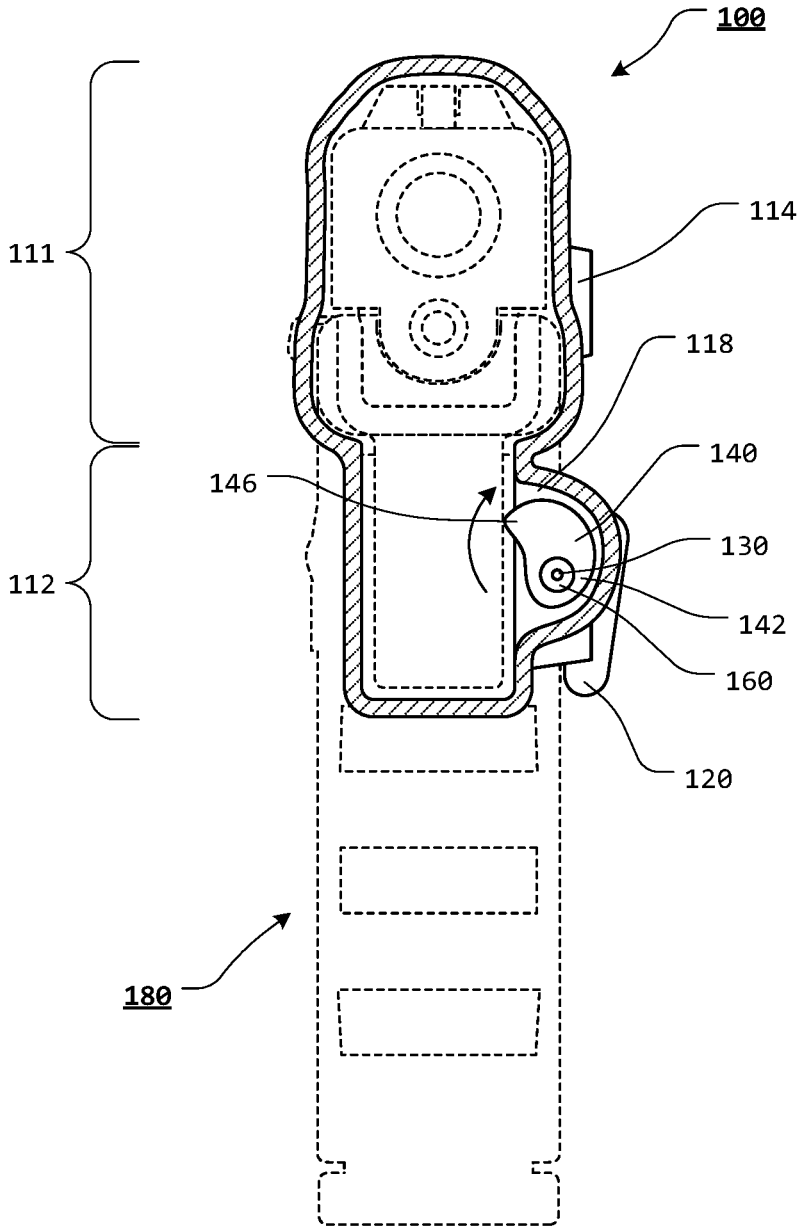
FIG. 8 illustrates a bottom, cross-sectional view, taken along line 6-6 of FIG. 1, of an exemplary embodiment of a holster, wherein an exemplary handgun is further partially inserted within the holster, according to the presently disclosed systems, methods, and/or apparatuses.

As the handgun 180 is further seated into the holster 100, the trigger guard 186 continues to travel from the proximal end 141 of the locking element 140 toward the distal end 142 of the locking element 140, the trigger guard 186 continues to displace the first helical portion 145 of the locking projection portion 146 and the locking element 140 continues to rotate, as illustrated in FIG. 8, until the trigger guard 186 passes a point of contact with a farthest extent of the locking projection portion 146 and clears the distal end 142 of the locking element 140.

Figure 9:
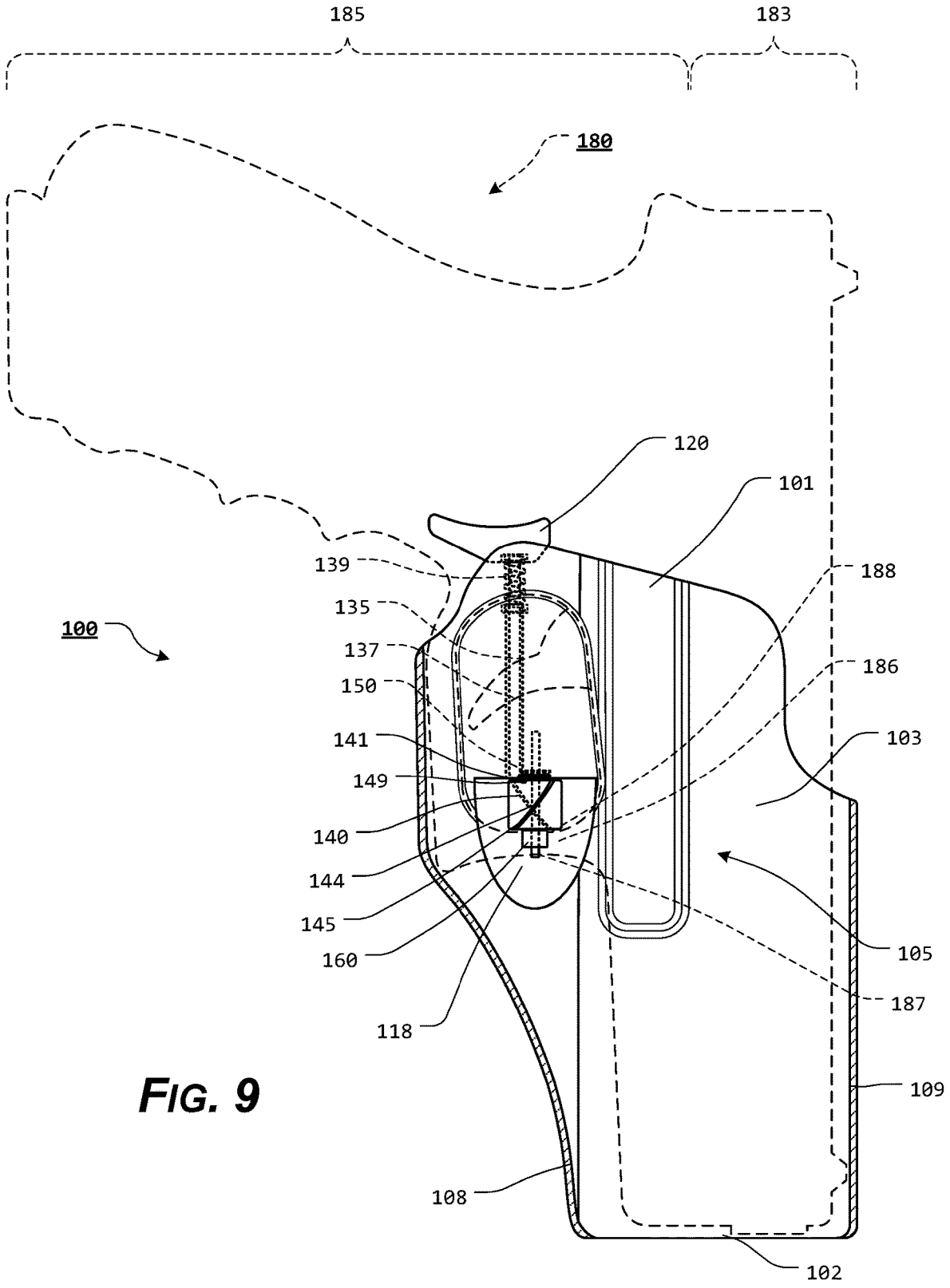
FIG. 9 illustrates a right side, cross-sectional view of an exemplary embodiment of a holster, wherein an exemplary handgun is seated within the holster, according to the presently disclosed systems, methods, and/or apparatuses.
Figure 10:
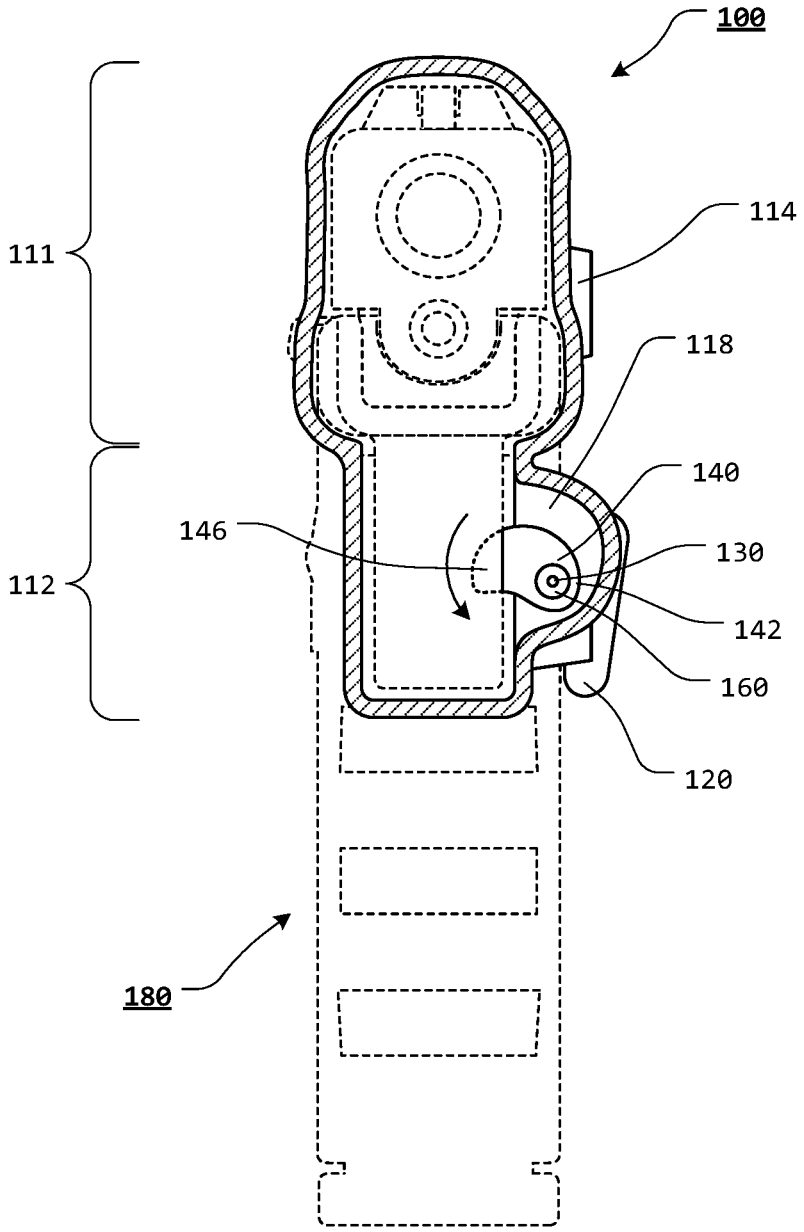
FIG. 10 illustrates a bottom, cross-sectional view, taken along line 6-6 of FIG. 1, of an exemplary embodiment of a holster, wherein an exemplary handgun is seated within the holster, according to the presently disclosed systems, methods, and/or apparatuses.
Figure 11:
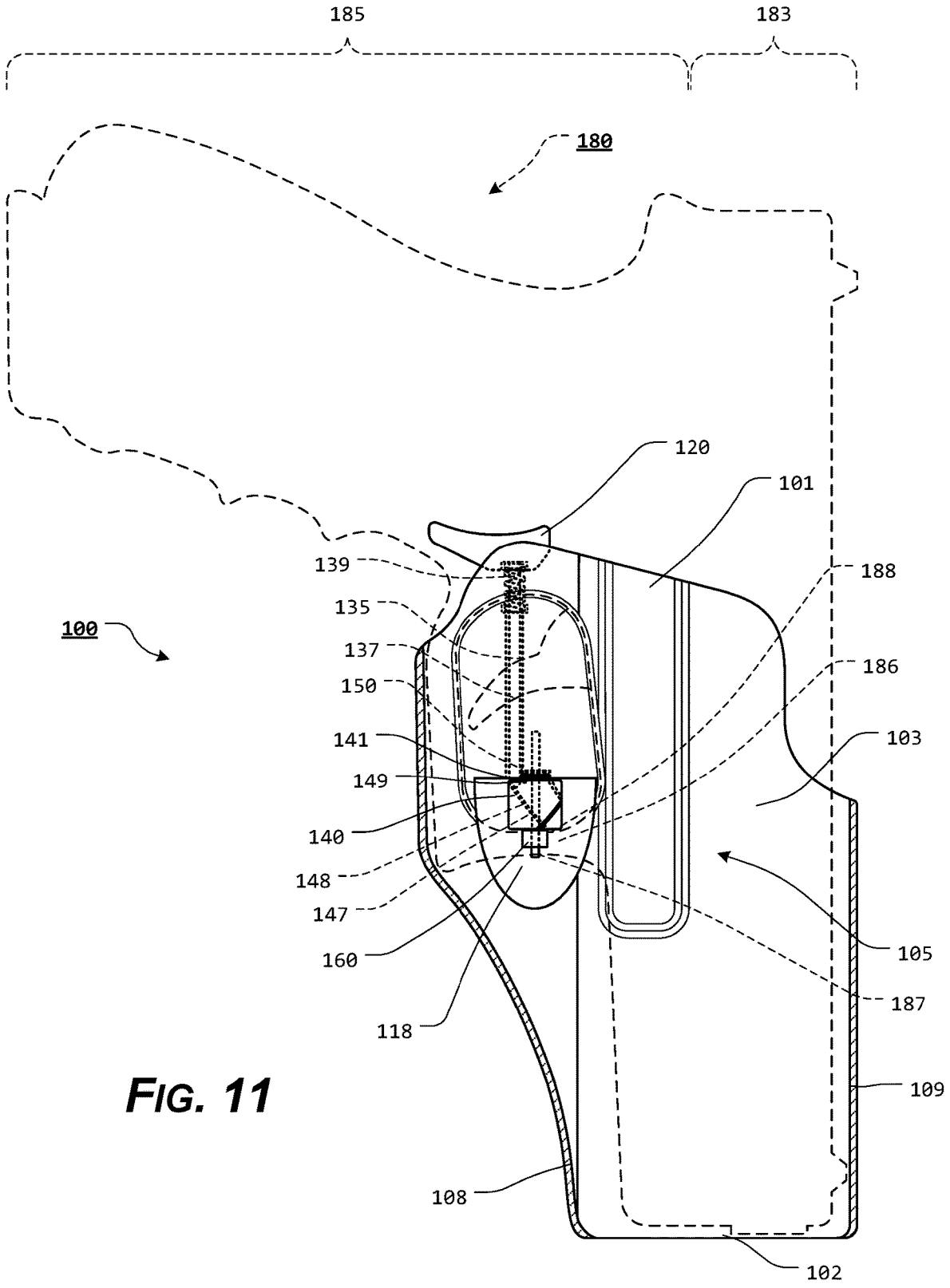
FIG. 11 illustrates a right side, cross-sectional view of an exemplary embodiment of a holster, wherein an exemplary handgun is seated within the holster and the locking element is rotated towards a release position, according to the presently disclosed systems, methods, and/or apparatuses.

When the trigger guard 186 passes the locking projection portion 146, the locking element 140 may be biased, via the locking element biasing element 150, to rotate the locking element 140 back to the retention position, as illustrated in FIGS. 9 and 10.

Thus, the locking element 140 is rotated to the release position as the outer surface of the trigger guard 186 contacts the first helical portion 145 of the locking element 140 and is automatically rotated to the retention position, via the locking element biasing element 150, when the inner surface 188 of the trigger guard 186 has passed the locking projection portion 146.

When the locking element 140 is rotated back to the retention position, the locking projection portion 146 extends such that at least a portion of the distal end 142 of the locking element 140 contacts the inner surface 188 of the trigger guard 186 and resists or blocks rearward movement of the handgun 180 if a removal force is applied to the handgun 180. In this manner, the handgun 180 is secured in the at least partial holster cavity portion 104 of the holster 100 by operation of the at least a portion of the distal end 142 of the locking element 140 blocking removal of the handgun 180, by contacting the inner surface 188 of the trigger guard 186. Thus, the trigger guard 186 is prevented from moving in a direction opposite the locking projection portion 146 by the interior surfaces of the holster 100.

While the handgun 180 is fully seated in the at least partial holster cavity portion 104 of the holster 100 with the locking element 140 biased to the retention position, removal of the handgun 180 is not permitted, as the locking projection portion 146 does not allow the trigger guard 186 to pass by. When the handgun 180 is secured in place, removal force applied to the handgun 180 will not remove the handgun 180 from the holster 100 unless the release lever 120 is urged downward and the locking projection portion 146 is brought out of the way of the inner surface 188 of the trigger guard 186.

In order to release and unholster the handgun 180, the release lever 120 is urged toward the release position (typically by applying a force to the release lever 120 sufficient to overcome the biasing force of the release lever biasing element 139), by urging the release lever 120 towards the locking element 140. As the release lever 120 is urged downward, toward the locking element 140, the first end of the pushrod 135 contacts the second helical portion 147 and/or the second helical ramp surface 148. As the release lever 120 (and the pushrod 135) continue to be urged toward the locking element 140, interaction between the first end of the pushrod 135 and the second helical ramp surface 148 of the second helical portion 147 causes the locking element 140 to rotate, about the rotation pin 130.

At some point, as the release lever 120 is further urged toward the release position, the bias of the locking element 140 is overcome, the release lever 120 is rotated towards the release position, and the locking projection portion 146 of the locking projection portion 146 is at least partially withdrawn from the interior of the trigger guard 186.

When the release lever 120 has been rotated sufficiently, such that the locking projection portion 146 of the locking element 140 is sufficiently withdrawn, the locking projection portion 146 clears the inner surface 188 of the trigger guard 186, the trigger guard 186 will no longer be blocked by the locking projection portion 146, and the handgun 180 can be withdrawn from the holster 100, as illustrated in FIG. 12.

The holster 100, as shown and described with reference to FIGS. 1-12, is oriented such that the release lever 120 is generally accessible by the user's thumb. However, in various other exemplary embodiments, the release lever 120 may optionally be positioned so that it is generally accessible by one or more of the user's other fingers.

It should be appreciated that the holster 100 is generally illustrated as being a right-hand holster. However, the structure and/or elements of the holster 100 may be positioned so as to provide a left-hand holster.

FIGS. 15-32 illustrate certain elements and/or aspects of an illustrative, non-limiting embodiment of a holster 200 according to the present disclosure. It should be understood that various components and/or elements of the holster 200 having like reference numerals or names refer to like parts of the holster 100 may optionally correspond to and operate similarly to the components and/or elements of the holster 100.

It should be appreciated that the holster 200 is adapted to retain an exemplary semiautomatic-type handgun 180.

In various exemplary embodiments, as illustrated in FIGS. 15-32, the holster 200 includes a holster body 203 defining an at least partial cavity portion 204 for receiving and holding at least a portion of the handgun 180. The at least partial cavity portion 204 may be formed from any number or combination of walls, including, for example, a single, continuous wall or multiple coupled or joined walls. Alternatively, the at least partial cavity portion 204 may be formed by a material shaped or bent in a substantial "U" shape. Thus, the at least partial cavity portion 204 may be formed by any at least partial holster cavity, space, or platform that is capable of retaining an appropriate portion of the handgun 180.

In various exemplary embodiments, the holster body 203 comprises at least some of a pair of opposed wall portions comprising a first wall portion 206 and a second wall portion 207. Typically, the first wall portion 206 is considered the inner side of the holster 200 and is worn against or adjacent the user's body, while the second wall portion 207 is considered the outer side of the holster 200 and is worn away from the user's body.

The holster body 203 may further comprise at least some of a fourth wall portion 209 and a third wall portion 208. Optionally, the fourth wall portion 209 and the third wall portion 208 may comprise extended portions of the first wall portion 206 and the second wall portion 207.

It should also be appreciated that the holster 200 may be formed such that one or more of the first wall portion 206, the second wall portion 207, the fourth wall portion 209, and/or the third wall portion 208 is/are sufficient to define the at least partial cavity portion 204 for receiving the handgun 180 and the remaining wall portions are not included.

It should be noted that the walls of the holster 200 may be substantially planar. Alternatively, the walls of the holster 200 may be contoured or shaped to better accommodate a specific type or model of handgun 180 (or other item) to be retained within the holster 200.

The at least partial at least partial cavity portion 204 includes a holster frame top portion 201 and a holster frame bottom portion 202 and may be formed from any number or combination of wall portions, including, for example, a single, continuous wall portion or multiple coupled or joined wall portions. Thus, the at least partial cavity portion 204 may be formed by any cavity, partial cavity, space, or platform that is capable of retaining a handgun 180.

In certain exemplary, nonlimiting embodiments, the holster body 203 merely comprises a single wall portion, such as, for example, the first wall portion 206. Any remaining portions of the holster 200 may be attached, coupled, or formed as a portion or extension of the first wall portion 206 and/or the holster body 203.

In certain exemplary, nonlimiting embodiments, as illustrated, the holster body 203 and/or the at least partial cavity portion 204 includes a holster slide portion 211 and a holster trigger guard portion 212. At least a portion of the holster trigger guard portion 212 is shaped to receive and accommodate at least a portion of the trigger guard 186 of an inserted handgun 180. In various exemplary embodiments, the holster trigger guard portion 212 is generally formed by a portion of the body of the holster 200. The holster trigger guard portion 212 is shaped generally to match the contours of at least a portion of the outer surface 187 of the trigger guard 186. The holster trigger guard portion 212 is formed to contact at least a portion of the outer surface 187 of the trigger guard 186 of the inserted handgun 180 and further limit how far the handgun 180 can be inserted into the holster 200.

The construction of the holster 200 further facilitates alignment of at least a portion of an ejection port 184 of the handgun 180 with at least a portion of the handgun locking portion 245 and limiting lateral movement of the handgun 180 with respect to the handgun locking portion 245 without preventing a user from easily holstering or drawing the handgun 180.

In various exemplary embodiments, the holster 200 optionally includes at least one holster frame attachment portion 214, which provides one or more areas, portions, or devices for fastening the holster 200 to a belt loop or other holster holding device. Alternatively, the means for holster frame attachment portion 214 may comprise a clip or hook adapted to, for example, be clipped over or to a belt. In further exemplary embodiments, the holster frame attachment portion 214 may comprise one or more quick-disconnect or other couplings, which may be permanently or removably coupled to corresponding and cooperating coupling(s) provided on a belt or other carrier or platform. In still other exemplary embodiments, the holster 200 may comprise an integral belt, or may comprise one or more connections for attachment to a chest, ankle, leg, shoulder, or other harness or band, or for otherwise securing the holster 200 to a user or the user's apparel.

The holster 200 may be formed of a substantially rigid material, such as, for example, a polymeric material or a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, and/or various combinations of the foregoing.

In various exemplary embodiments, at least certain components of the holster 200 may be formed of any known or later developed, substantially flexible material(s) such as a polymeric material, leather, foam, foam laminates, natural and man-made (synthetic) fabrics, natural and man-made (synthetic) fabric laminates, moldable honeycomb materials, or the like, and/or various combinations of the foregoing.

Thus, it should be understood that the material or materials used to form the holster 200 and/or various components of the holster 200 is a design choice based on the desired appearance and/or functionality of the holster 200.

The holster 200 comprises a locking element 240. The locking element 240 is capable of operating to retain a handgun 280 securely in the holster 200 by restricting withdrawal of the handgun 280 from the at least partial holster cavity portion 204 of the holster 200 when in a locking element retention position, while permitting a release of the handgun 280 when in a locking element release position.

The locking element 240 includes a locking element first side facing generally outward from the holster 200, away from the at least partial cavity portion 204 formed by the holster 200 and a locking element second side facing toward the at least partial cavity portion 204 formed by the holster 200.

In various exemplary, nonlimiting embodiments, the locking element 240 is substantially arcuate in overall shape and extends from a rotation portion 243 to a locking engagement portion 244. The rotation portion 243 comprises a substantially cylindrical portion that extends from a proximal end 241 to a distal end 242 and includes a helical portion 248 formed in or around at least a portion of the locking element 240. In certain alternative embodiments, the rotation portion 243 may have an overall cylindrical or conical shape.

The helical portion 248 begins at or proximate the proximal end 241 and extends to at least a portion of the distal end 242 of the rotation portion 243.

In various exemplary embodiments, the rotation portion 243 includes a helix or helical protrusion or helical portion 248 that extends from at least a portion of the surface of the rotation portion 243, forming a helically threaded portion. Alternatively, the rotation portion 243 includes a helix or helical recess formed in at least a portion of the surface of the rotation portion 243. Whether a protrusion or recess, the helical portion 248 provides a helical ramp surface 249 or incurved rim that curves around at least a portion of the rotation portion 243. In certain exemplary embodiments, the helical portion 248 or helical ramp surface 249 generally follows a spiral or a curve along a portion of the rotation portion 243 that can be defined by the rotation of a point crossing cross-sections (taken perpendicular to the longitudinal axis of the rotation portion 243) of the helical portion 248, at a consistent, oblique angle.

The helical portion 248 optionally begins at or proximate the proximal end 241 (generally on an opposing side of the rotation portion 243 from the beginning of the helical portion 248) and extends toward or to the distal end 242 of the rotation portion 243.

In various exemplary embodiments, the rotation portion 243 includes a helix or helical protrusion or helical portion 248 that extends from at least a portion of the surface of the rotation portion 243, forming a helically threaded portion. Alternatively, the rotation portion 243 includes a helix or helical recess formed in at least a portion of the surface of the rotation portion 243. Whether a protrusion or recess, the helical portion 248 provides a helical ramp surface 249 or incurved rim that curves around at least a portion of the rotation portion 243. In certain exemplary embodiments, the helical portion 248 or helical ramp surface 249 generally follows a spiral or a curve along a portion of the rotation portion 243 that can be defined by the rotation of a point crossing cross-sections (taken perpendicular to the longitudinal axis of the rotation portion 243) of the helical portion 248, at a consistent, oblique angle.

In various exemplary embodiments, the helical portion 248 (including the helical ramp surface 249) and the helical portion 248 (including the helical ramp surface 249) are formed as a single, continuous, helical ramp surface 249. Thus, the rotation portion 243 may include a single helical portion having a single helical ramp surface or a double helical portion having a first helical portion with a first helical ramp surface and a second helical portion with a second helical ramp surface.

In various exemplary embodiments, the helical portion 248 (including the helical ramp surface 249) may optionally be formed as a multipart or multi-ramped surface. For example, the helical portion 248 may be comprised of an initial helical portion and a subsequent helical portion. By forming the helical portion 248 as a multipart or multi-ramped surface, as the first end of the pushrod 235 contacts the initial helical portion, continuing lateral movement of the pushrod 235 (along the longitudinal axis of the pushrod 235), along the initial helical portion, produces a first degree of angular rotation of the locking element 240. As the pushrod 235 is urged further toward the locking element 240, the first end of the pushrod 235 transitions from contacting the initial helical portion and contacts the subsequent helical portion. As the first end of the pushrod 235 contacts the subsequent helical portion, continuing lateral movement of the pushrod 235, along the subsequent helical portion, produces a second degree of angular rotation of the locking element 240.

In various exemplary embodiments, the initial helical portion may optionally have a shallower pitch than the subsequent helical portion. Alternatively, the initial helical portion may have a pitch that is steeper than the pitch of the subsequent helical portion. Furthermore, the number of helical portions comprising the helical portion 248 is a design choice. Additionally, the pitch or angle of each portion of the helical portion 248 is also a design choice.

Thus, different or varying angular ramped or other surfaces along the locking element 240 can allow different degrees of angular rotation of the locking element, as the pushrod 235 engages different portions of the helical portion 248 and the helical ramp surface 249. In this manner, different angles of rotation of the locking element 240, as the helical portion 248 and the helical ramp surface 249 are engaged by the pushrod 235 can be produced, based upon the position of the first end of the pushrod 235 along the helical portion 248. It should be appreciated that the pitch, angle, or presentation of the helical portion 248 and the helical ramp surface 249 is a design choice based upon the desired level of angular rotation of the locking element 240 at various positions of the pushrod 235. Therefore, alterations in the pitch, angle, or presentation of the helical portion 248 and the helical ramp surface 249 and alter the engagement or clearance of mating or engaging surfaces of the pushrod 235 and the helical portion 248 and the helical ramp surface 249.

The locking engagement portion 244 includes a handgun locking portion 245 formed of a protrusion on the locking element second side of the locking engagement portion 244.

The handgun locking portion 245 includes a substantially planar portion 247 having a substantially planar surface facing toward the holster frame bottom portion 202. The substantially planar portion 247 is generally formed so as to extend into at least a portion of the ejection port 184 of an inserted handgun 180 and engage a surface of the ejection port 184. In this manner, when the locking element 240 is in the locking element retention position, the substantially planar portion 247 of the handgun locking portion 245 extends into at least a portion of the ejection port 184 of an inserted handgun 180 and contacts a surface of the ejection port 184 and resists a withdrawing force applied to the handgun 180, maintaining the handgun 180 within the at least partial cavity portion 204.

In various exemplary, non-limiting embodiments, the locking element 240 is pivotally attached or coupled to the holster body 203, via the locking element pivot pin 230 positioned through the locking element pivot pin aperture 232 formed through the locking element 240, so that the locking element 240 is repeatably pivotable between a locking element retention position and a locking element release position. The locking element pivot pin 230 may be positioned substantially parallel to a longitudinal axis, $A_L$, of the holster 200, substantially perpendicular to a longitudinal axis, $A_L$, of the holster 200, at a substantially acute angle relative to a longitudinal axis, $A_L$, of the holster 200, or at a substantially obtuse angle relative to a longitudinal axis, $A_L$, of the holster 200. Thus, the locking element pivot pin 230 may be positioned at any angle relative to a longitudinal axis, $A_L$, of the holster 200.

In various exemplary embodiments, the locking element 240 is attached or coupled to the rotation pin 230 at a cross-sectional center of the rotation portion 243. Alternatively, the locking element 240 is attached or coupled to the rotation pin 230 at a point that is offset from the cross-sectional center of the rotation portion 243. Thus, the locking element 240 may be rotated by the rotation pin 230 in a substantially consistent or offset manner.

In certain exemplary, nonlimiting embodiments, the rotation pin 230 comprises a separate portion of material extending out of or from the holster body 203. Alternatively, the rotation pin 230 may optionally comprise an extension of material used to form at least a portion of the holster body 203. Thus, the rotation pin 230 may comprise a separate element or an integral component that extends from the holster body 203.

It should be appreciated that the locking element pivot pin 230 may extend either all or part of the way across the rotation portion 243 of the locking element 240.

In certain exemplary embodiments, the rotation portion 243 of the locking element 240 may include one or more protrusions that replace the locking element pivot pin 230 and extend from the rotation portion 243 of the locking element 240. Corresponding indentions, indentations, notches, grooves, or dimples may be formed in the holster body 203. In these exemplary embodiments, the protrusions are formed so as to operate in cooperating relationship with the first and second dimples such that the rotation portion 243 of the locking element 240 may be pivotally attached, via the protrusions and the dimples, to the holster body 203 within the rotation portion 243 of the locking element 240. Thus, the locking element 240 is able to snap fit into a portion of the holster body 203.

Alternatively, the positions of the protrusions and the first and second dimples may be reversed, such that the rotation portion 243 of the locking element 240 may include dimples while the holster body 203 includes protrusions. In these exemplary embodiments, the dimples are formed so as to operate in cooperating relationship with the protrusions such that the rotation portion 243 of the locking element 240 may be pivotably attached, via the dimples and the protrusions, to the holster body 203, within the rotation portion 243 of the locking element 240.

In various exemplary embodiments, the locking element 240 is attached or coupled to the first wall portion 206. It should be appreciated that in various exemplary embodiments, the locking element 240 may be attached or coupled to any wall portions of the holster body 203.

The locking element 240 is pivotable between a locking element retention position and a locking element release position. When the locking element 240 is in the locking element retention position, at least a portion of the handgun locking portion 245 is positioned so as to extend through an aperture 205 in, for example, the first wall portion 206 of the holster body 203 and protrude into a portion of the at least partial cavity portion 204 a sufficient distance to engage at least a portion of the ejection port 184 of the handgun 180 appropriately seated within the at least partial cavity portion 204. When the locking element 240 in the locking element release position, the handgun locking portion 245 is withdrawn from the at least partial cavity portion 204, through the aperture 205, a sufficient distance to disengage from the ejection port 184 of the handgun 180 appropriately seated within the at least partial cavity portion 204 to allow the handgun 180 to be withdrawn from the at least partial cavity portion 204.

When the locking element 240 is pivoted to the locking element release position and the substantially planar portion 247 is withdrawn and does not contact a surface of the ejection port 184, the handgun 180 can be withdrawn from the at least partial cavity portion 204.

In various exemplary embodiments, a ramp portion 246 is included in a portion of the handgun locking portion 245 facing toward the holster frame top portion 201. The ramp portion 246 is generally formed so as to be contacted by a portion of the slide portion 183 or any other portion of an inserted handgun 180, as the handgun 180 is being inserted within the at least partial cavity portion 204, to urge the locking element 240 toward the locking element release position as the handgun 180 is inserted within the at least partial cavity portion 204.

In certain exemplary embodiments, particularly those in which the ramp portion 246 is included, when the handgun 180 is returned to the at least partial cavity portion 204, the slide portion 183 or other portion of the inserted handgun 180 may contact the ramp portion 246 of the handgun locking portion 245 and displaces the handgun locking portion 245 sufficient to pivot the locking element 240 such that the substantially planar portion 247 of the handgun locking portion 245 is displaced relative to the at least partial cavity portion 204. Thus, the substantially planar portion 247 does not prohibit insertion of the handgun 180 into the at least partial cavity portion 204.

Figure 28:
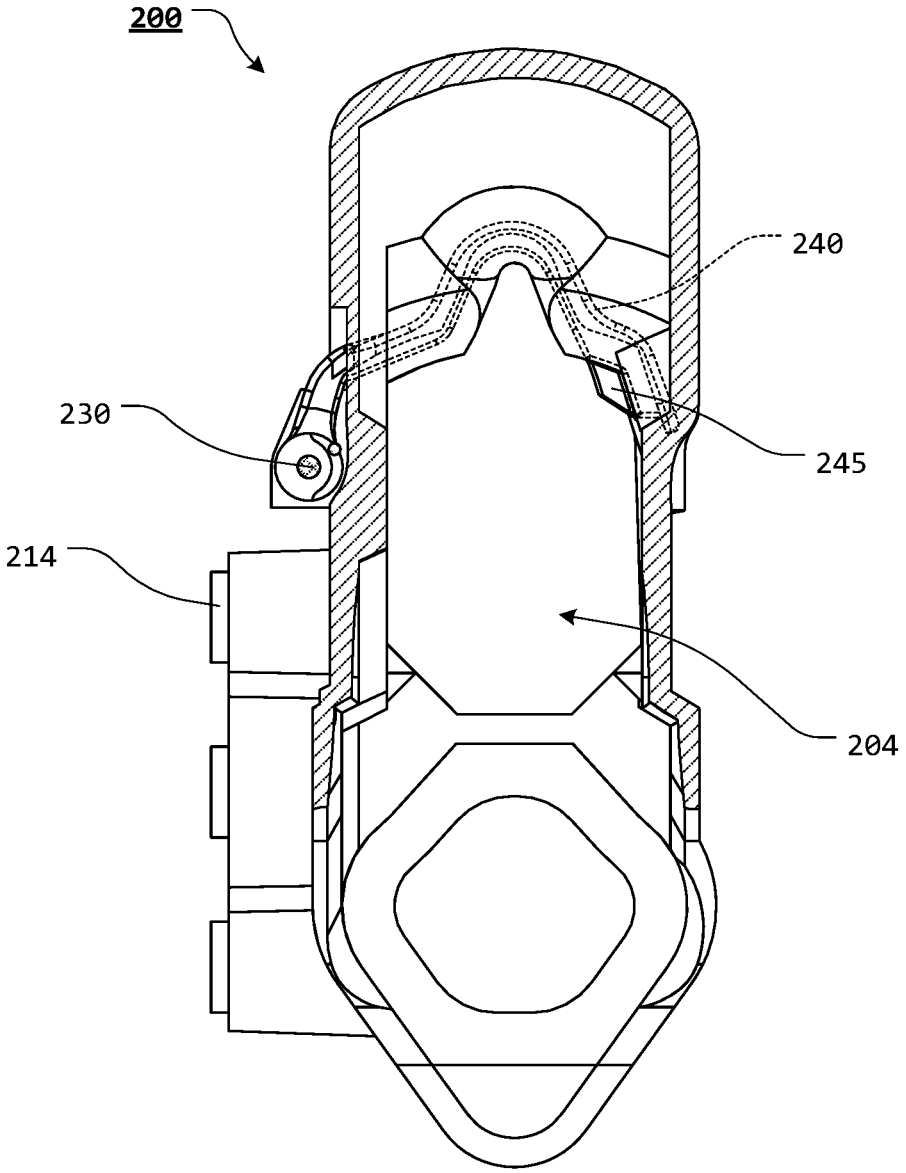
FIG. 28 illustrates a top, cross-sectional view of an exemplary embodiment of a holster, wherein the locking element is in a retention position, according to the present disclosure.
Figure 30:
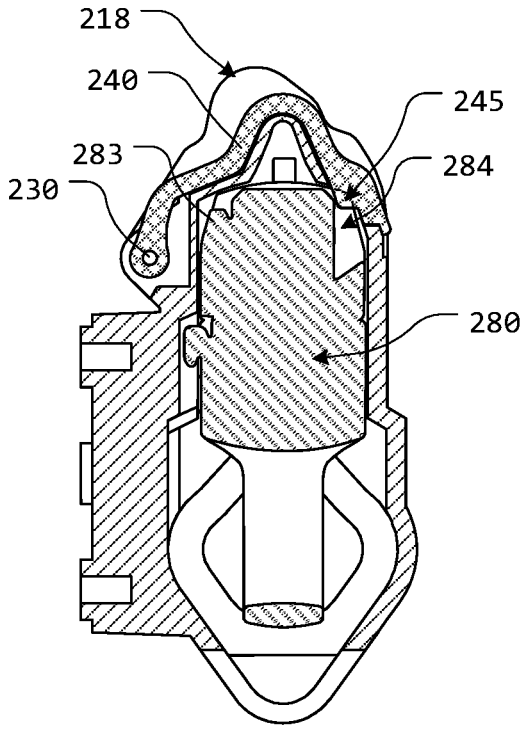
FIG. 30 illustrates a top, cross-sectional view of an exemplary embodiment of a holster, wherein the locking element is in a retention position, according to the present disclosure.

When the locking element 240 is in the locking element retention position, as illustrated, for example, in FIGS. 28 and 30, the handgun locking portion 245 is positioned so as to extend through an aperture 205 in the holster body 203, into a portion of the at least partial cavity portion 204.

Figure 29:
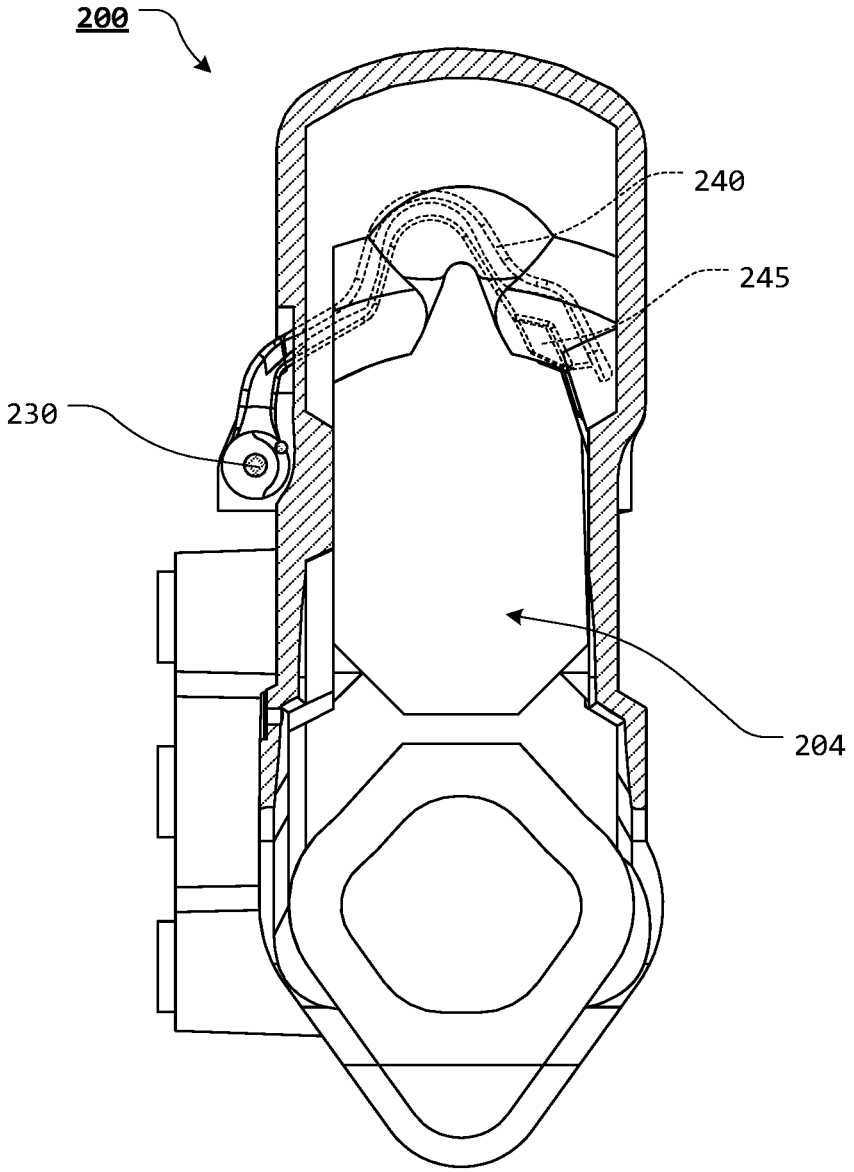
FIG. 29 illustrates a top, cross-sectional view of an exemplary embodiment of a holster, wherein the locking element is in a release position, according to the present disclosure.
Figure 31:
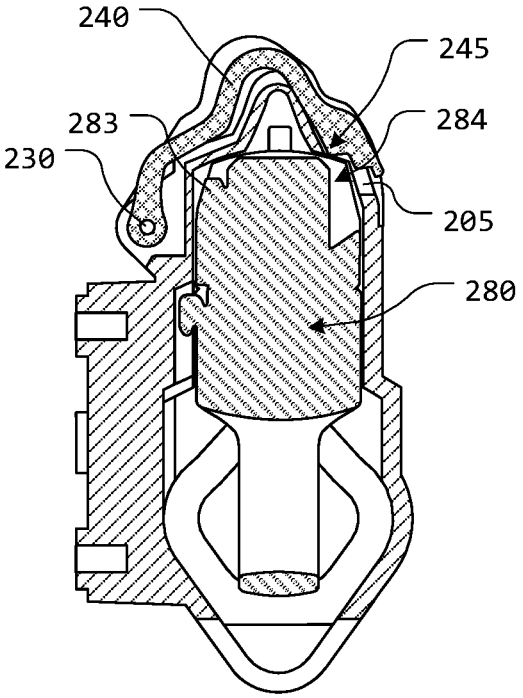
FIG. 31 illustrates a top, cross-sectional view of an exemplary embodiment of a holster, wherein the locking element is in a release position, according to the present disclosure.
Figure 32:
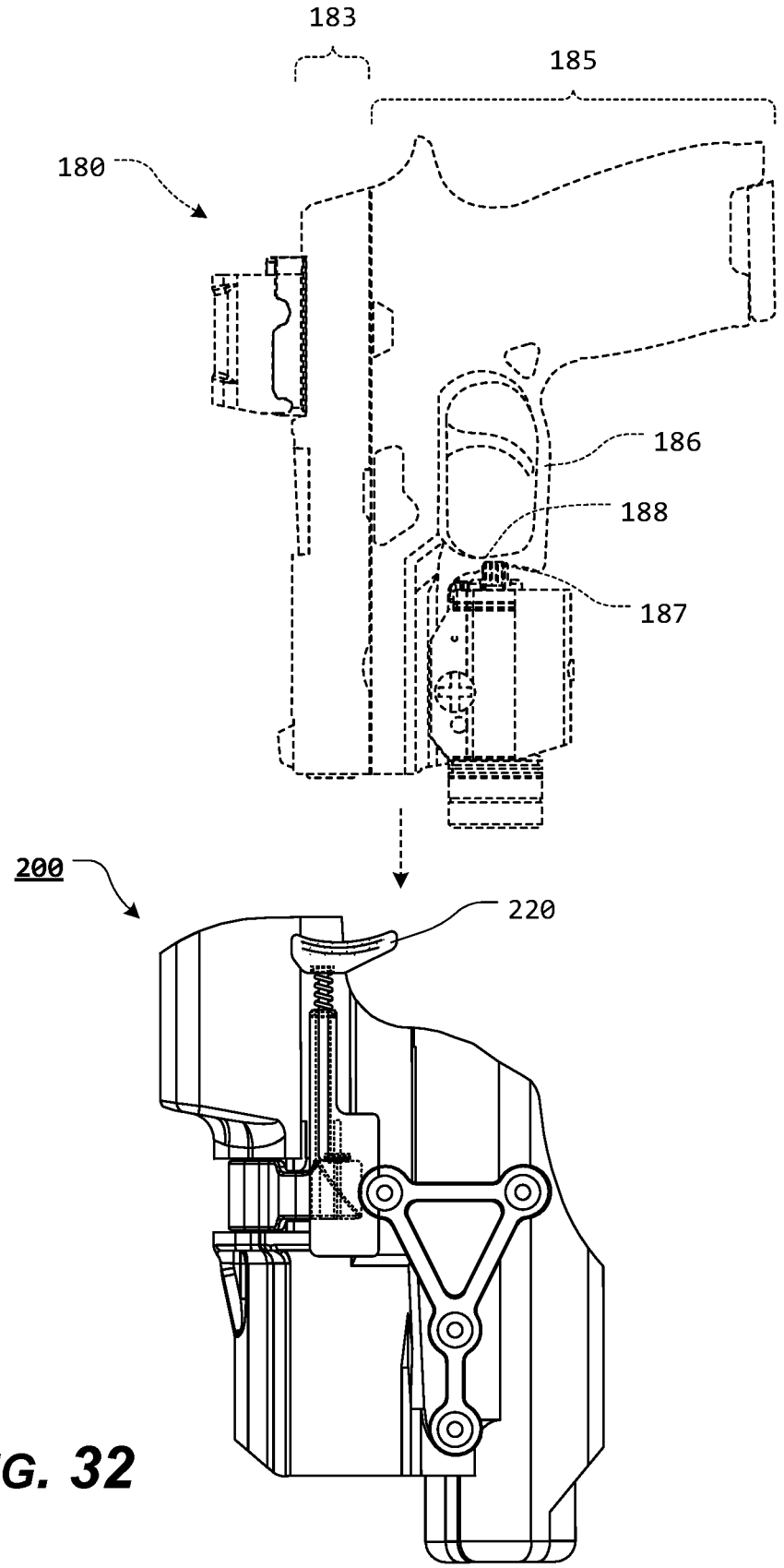
FIG. 32 illustrates a first side view of an exemplary embodiment of a holster, wherein an exemplary handgun is aligned for insertion within the holster, according to the present disclosure.

When the bias of the locking element 240 is overcome and the locking element 240 is pivoted from the locking element retention position, as illustrated, for example, in FIGS. 28 and 30, to the locking element release position, as illustrated, for example, in FIGS. 29 and 31, the handgun locking portion 245 is withdrawn a sufficient distance from within the at least partial cavity portion 204 to disengage from the ejection port 183 of the handgun 180 and allow the handgun 180 to be removed from the holster 200.

When the pivoting force is removed from the locking element 240, the locking element 240 returns to the locking element retention position, as illustrated, for example, in FIGS. 28 and 30.

It should be appreciated that the handgun 180 may not be removed from the holster 200 until the locking element 240 has been sufficiently pivoted to the locking element release position.

In various exemplary embodiments, the locking element 240 is biased, via interaction between the release lever biasing element 250 and the locking element 240, to the locking element retention position. In various exemplary embodiments, the release lever biasing element 250 may comprise a coil or other spring or any suitable spring mechanism or resilient element. The release lever biasing element 250 is attached or coupled to or within a portion of the holster body 203. In certain exemplary embodiments, the release lever biasing element 250 is molded or embedded within a portion of the holster body 203.

In various exemplary embodiments, the locking element 240 may optionally be biased to the locking element retention position, whether a handgun 180 is present in the holster 200 or absent from the holster 200. In various exemplary embodiments, biasing of the locking element 240 may be accomplished by, for example, a locking element biasing element 250 secured between at least a portion of the holster body 203 and at least a portion of the locking element 240. In various exemplary embodiments, the locking element 240 includes a biasing element receiving groove formed in the locking element 240 that engages an end portion of the locking element biasing element 250. The locking element biasing element 250 may comprise a coil or other spring or any suitable spring mechanism or resilient element.

The locking element 240 is rotatable within at least a portion of the holster trigger guard portion 212. In certain exemplary, nonlimiting embodiments, the locking element 240 is positioned at least partially within a holster recess 218 formed to allow the locking element 240 to rotate freely without contact or interaction from external objects are forces on a side opposite the holster recess 218.

A pushrod channel 237 is formed in or through at least a portion of the holster body 203. In various exemplary embodiments, the pushrod channel 237 is formed through the material forming the holster body 203. Alternatively, the pushrod channel 237 is formed to include an at least partial pushrod channel 237 insulator or other material. If included, the insulator or other material aids in the smooth slidable movement of at least a portion of the pushrod 235 within the pushrod channel 237. The pushrod channel 237 is formed to have an inner diameter that allows at least a portion of the pushrod 235 to be fitted within the pushrod channel 237 and substantially freely slide, in a lateral fashion, within the pushrod channel 237.

Generally, the pushrod channel 237 is formed proximate the holster trigger guard portion 212, such that when the pushrod 235 is slidably inserted within the pushrod channel 237, at least a first end portion of the pushrod 235 may extend to contact the helical ramp surface 249 of the helical portion 248 of the locking element 240.

In various exemplary embodiments, the pushrod channel 237 is positioned substantially parallel to a longitudinal axis, $A_L$, of the holster 200, substantially perpendicular to a longitudinal axis of the holster 200, at a substantially acute angle relative to a longitudinal axis of the holster 200, or at a substantially obtuse angle relative to a longitudinal axis of the holster 200. Thus, the pushrod channel 237 may be positioned at any angle relative to either a longitudinal axis, $A_L$, or other axis of the holster 200.

A release lever 220 is attached or coupled at a second end or proximate a second end of the pushrod 235. In certain exemplary embodiments, the release lever 220 is attached or coupled to a terminal second end of the pushrod 235. The pushrod 235 generally comprises an elongate portion of material extending from a first end to a second end. In various exemplary embodiments, the pushrod 235 has a substantially circular cross-section. Alternatively, the pushrod 235 may have a substantially ovular, triangular, square, octagonal, or other desired cross-section.

The release lever 220 includes a release lever first side 221 facing generally outward from the holster 200, away from the at least partial holster cavity portion 204, and a release lever second side 222 facing generally toward the at least partial holster cavity portion 204.

Portions of the release lever 220 may be smooth and non-textured. Alternatively, portions of the release lever 220 may include a textured portion 225 so that the user's thumb/finger does not easily slip off of the release lever 220 or so that the release lever 220 may be distinguished tactilely from other portions of the release lever 220 and/or the holster body 203.

Figure 15:
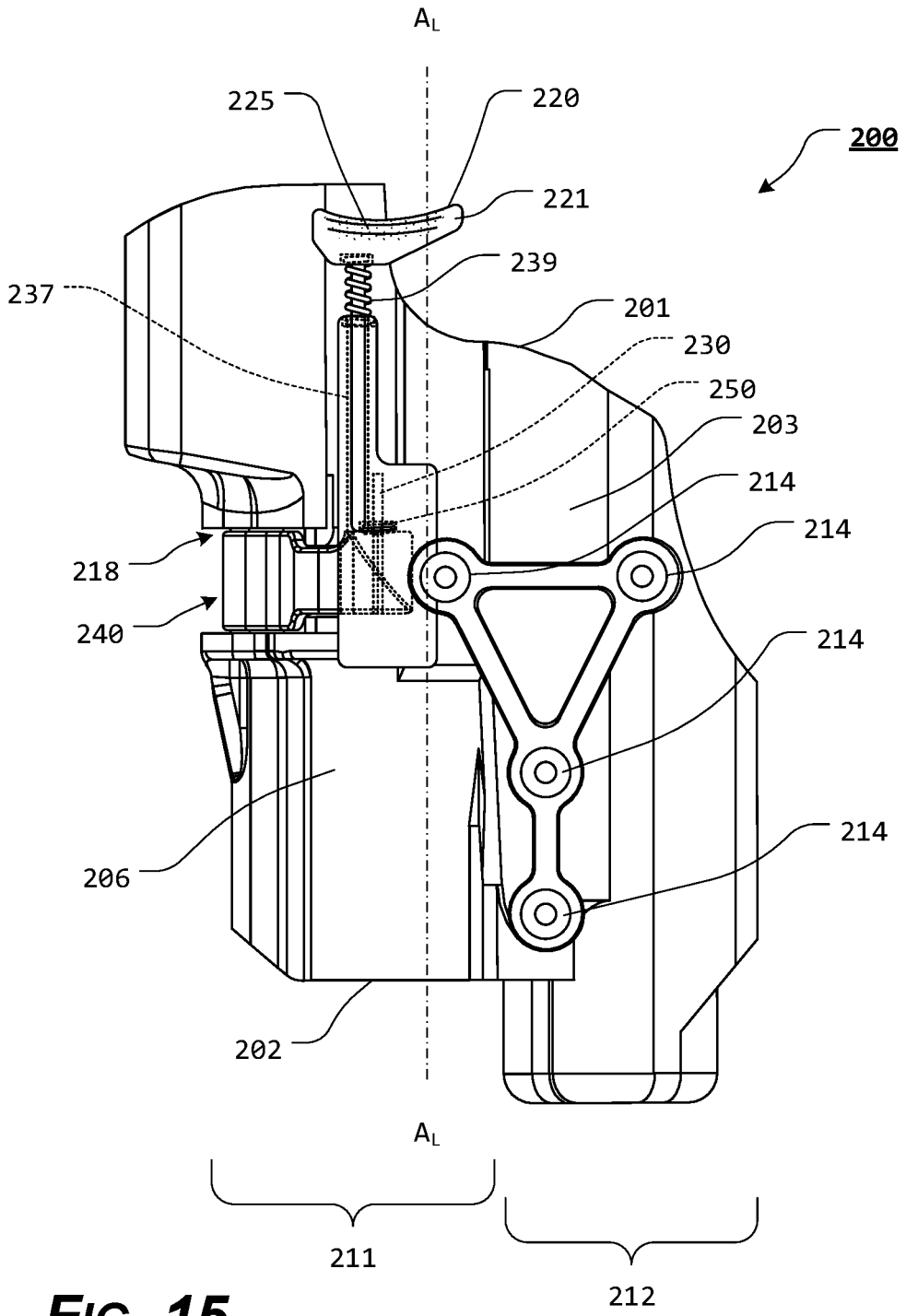
FIG. 15 illustrates a side view of an exemplary embodiment of a holster, wherein the locking element is in a retention position, according to the present disclosure.
Figure 16:
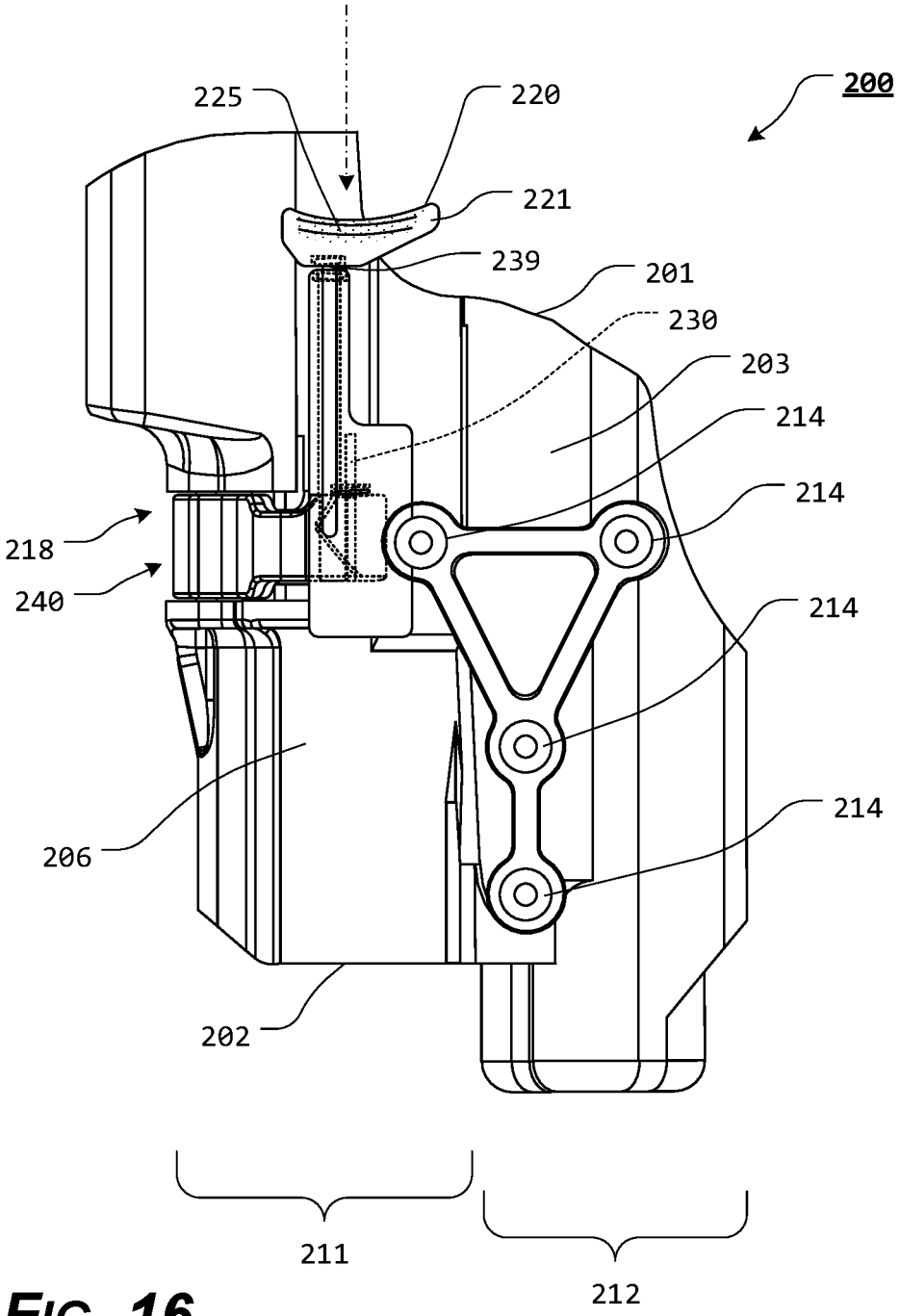
FIG. 16 illustrates a side view of an exemplary embodiment of a holster, wherein the locking element is in a release position, according to the present disclosure.
Figure 17:
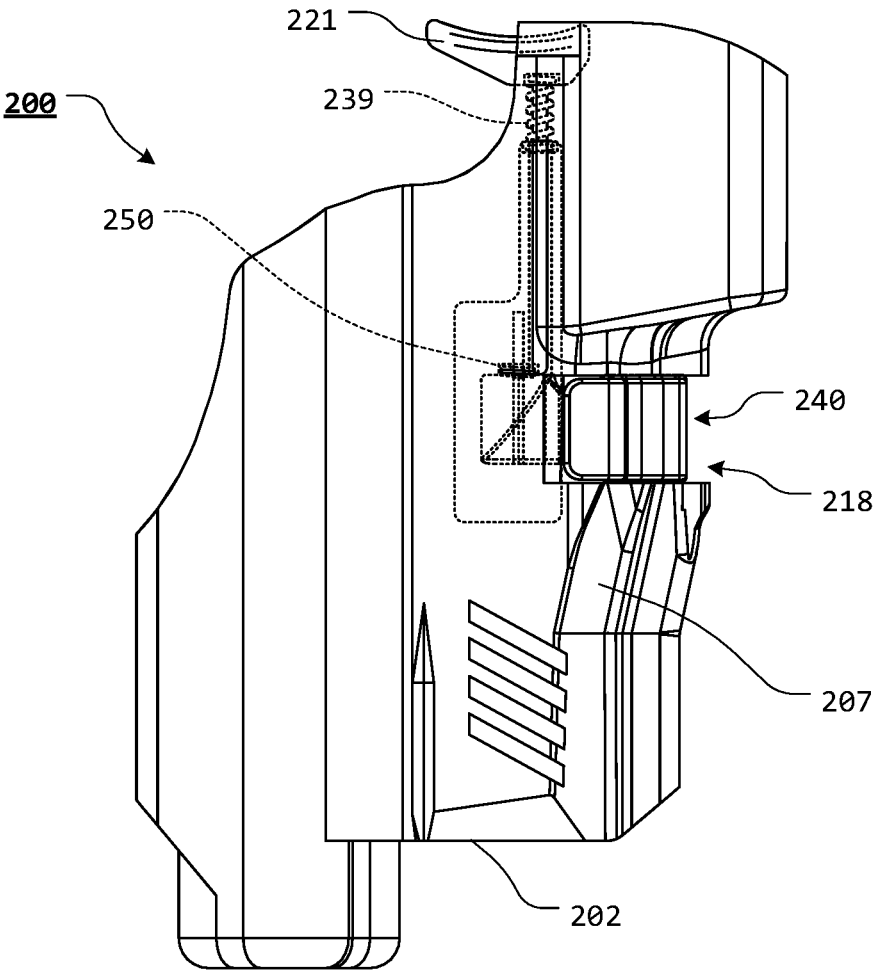
FIG. 17 illustrates a side view of an exemplary embodiment of a holster, wherein the locking element is in a retention position, according to the present disclosure.
Figure 18:
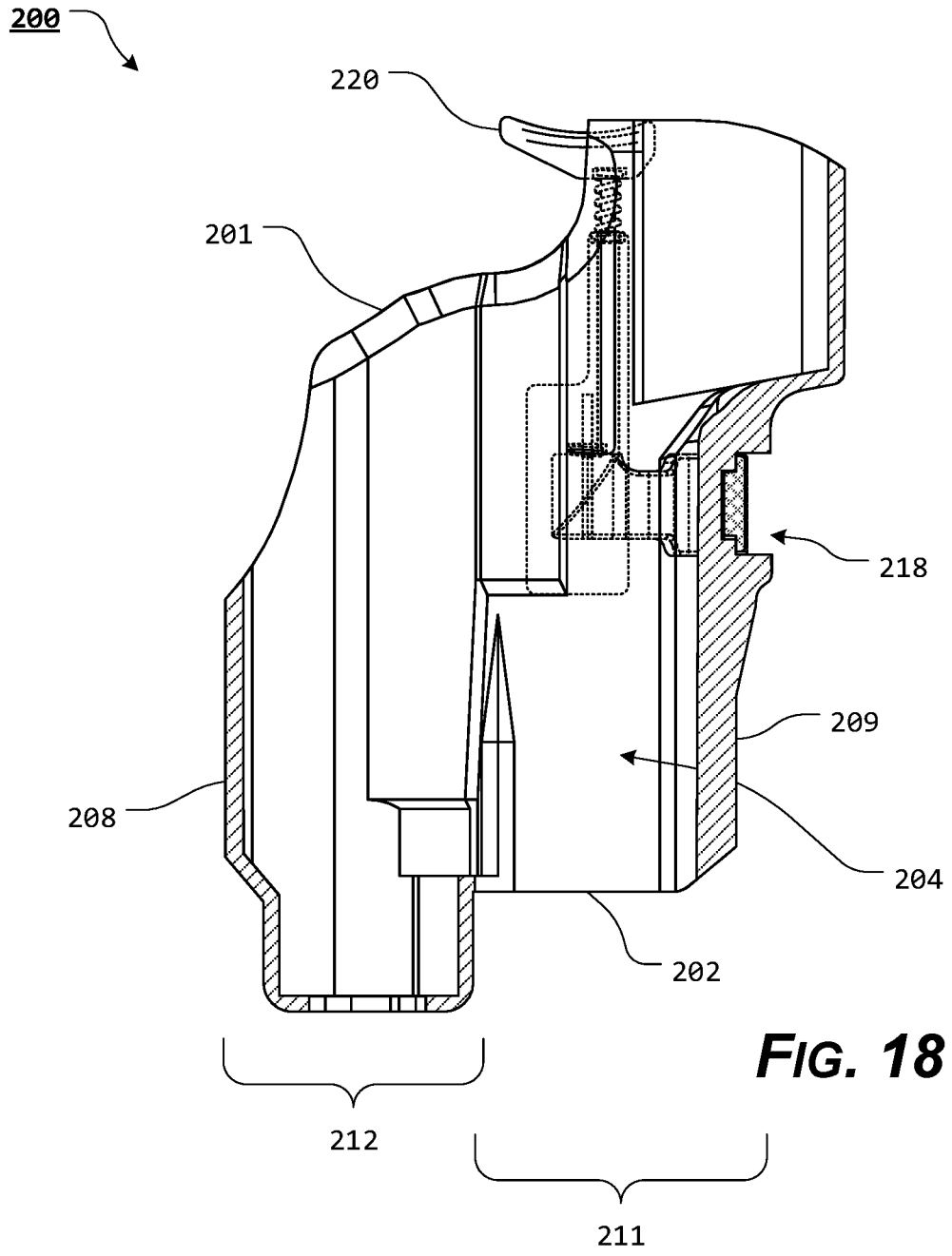
FIG. 18 illustrates a side, cross-sectional view of an exemplary embodiment of a holster, wherein the locking element is in a retention position, according to the present disclosure.
Figure 19:
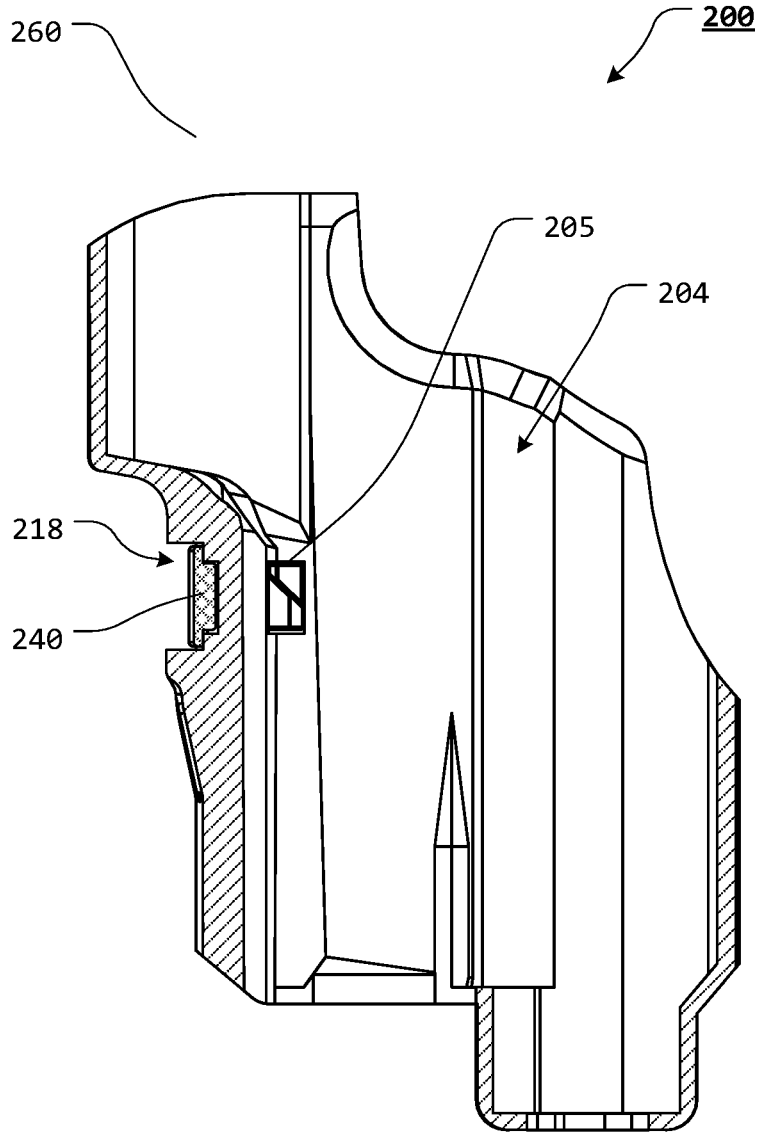
FIG. 19 illustrates a side, cross-sectional view of an exemplary embodiment of a holster, wherein the locking element is in a retention position, according to the present disclosure.
Figure 20:
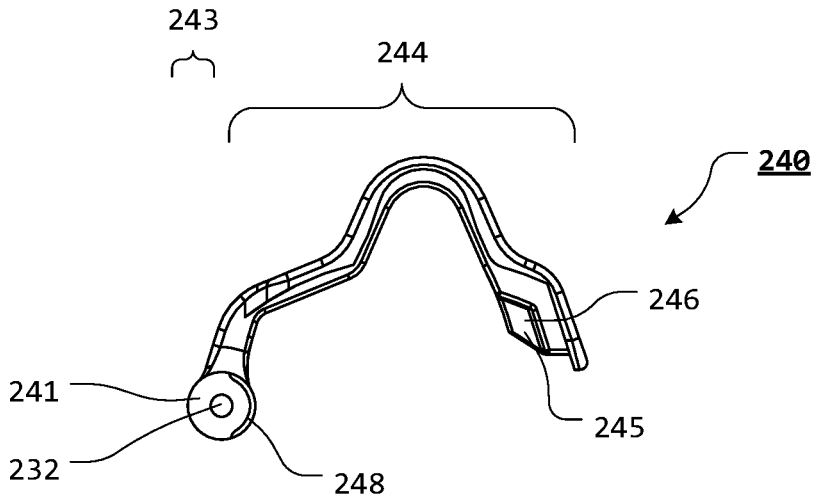
FIG. 20 illustrates a top view of an exemplary embodiment of a release lever, according to the present disclosure.
Figure 21:
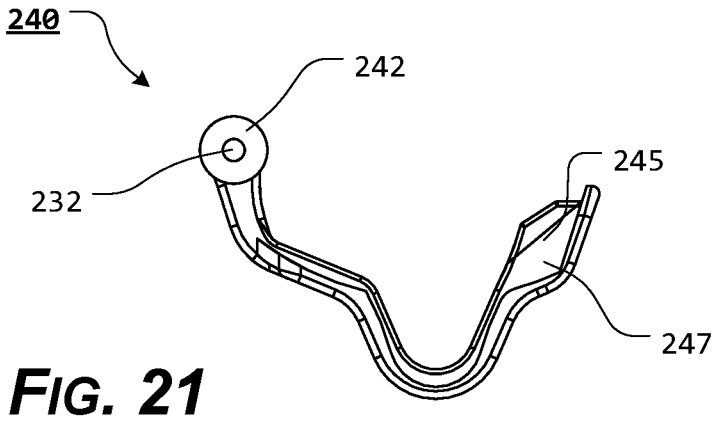
FIG. 21 illustrates a bottom view of an exemplary embodiment of a release lever, according to the present disclosure.
Figure 22:
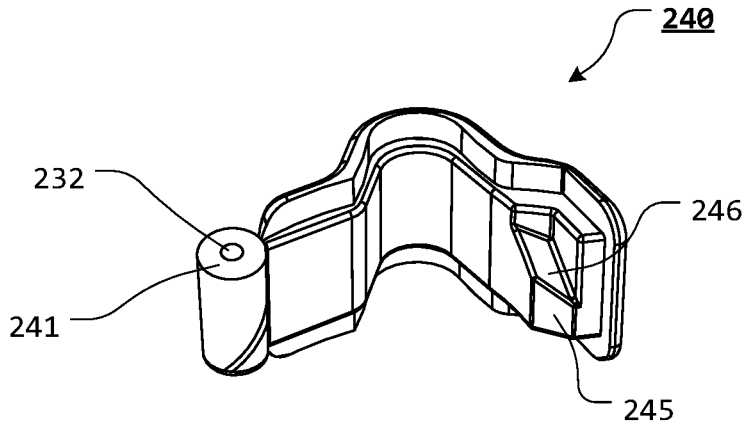
FIG. 22 illustrates an upper, rear perspective view of an exemplary embodiment of a release lever, according to the present disclosure.
Figure 23:
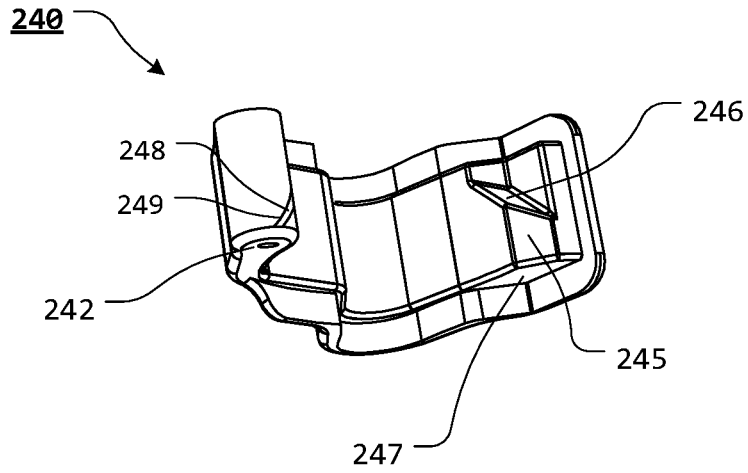
FIG. 23 illustrates a lower, rear perspective view of an exemplary embodiment of a release lever, according to the present disclosure.
Figure 24:
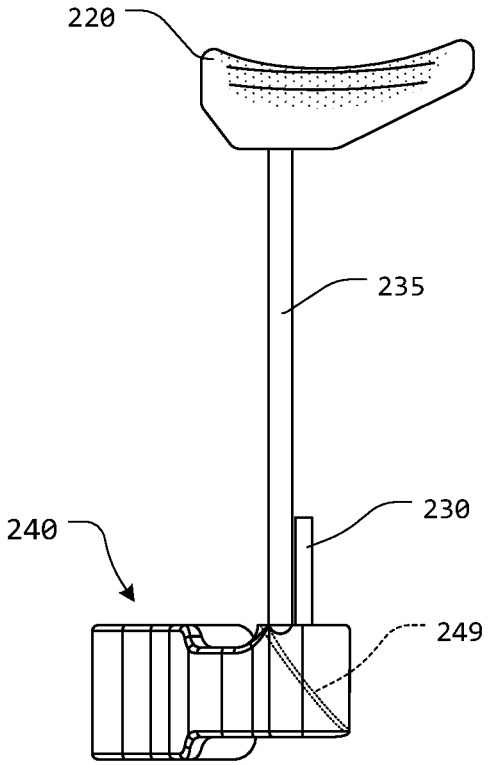
FIG. 24 illustrates a first side view of an exemplary embodiment of a release lever and a locking element, according to the present disclosure.
Figure 25:
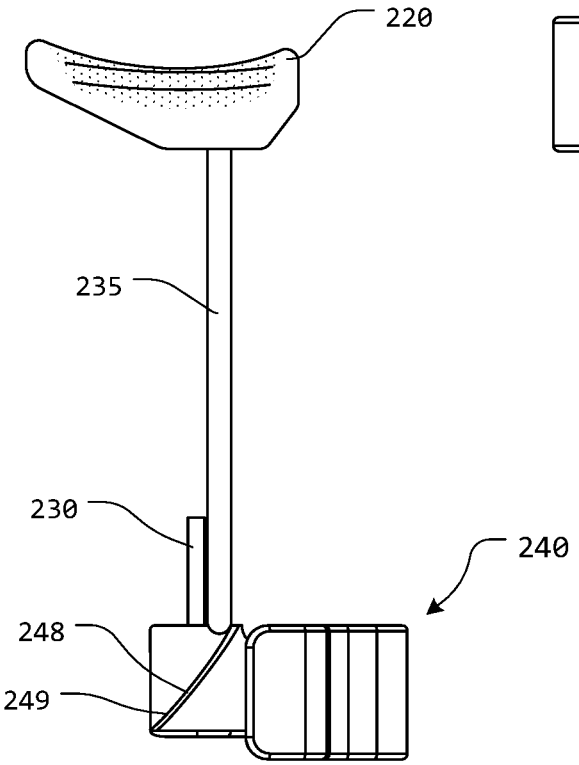
FIG. 25 illustrates a second side view of an exemplary embodiment of a release lever and a locking element, according to the present disclosure.
Figure 26:
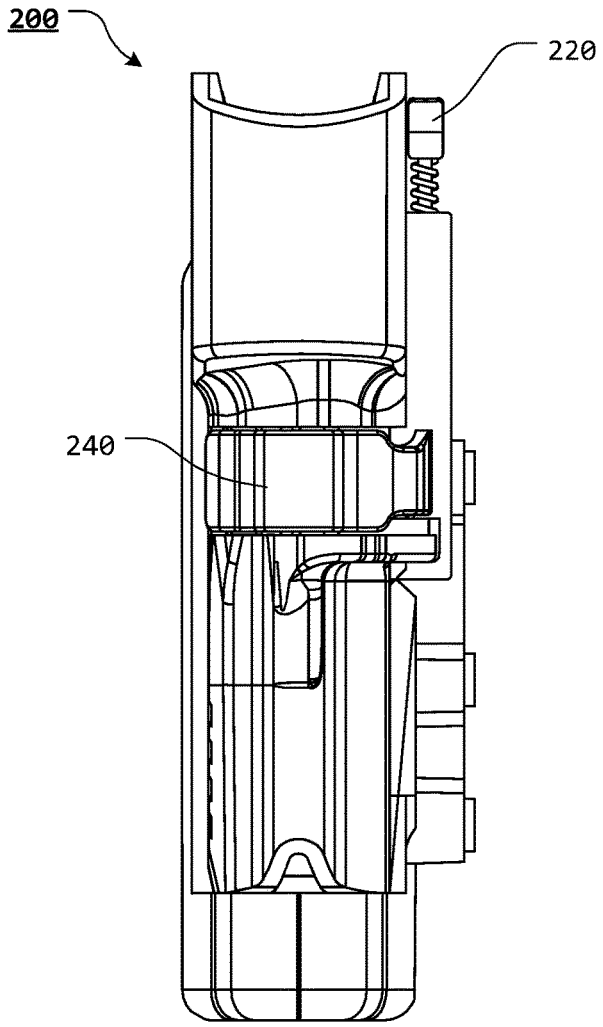
FIG. 26 illustrates a front view of an exemplary embodiment of a holster, according to the present disclosure.
Figure 27:
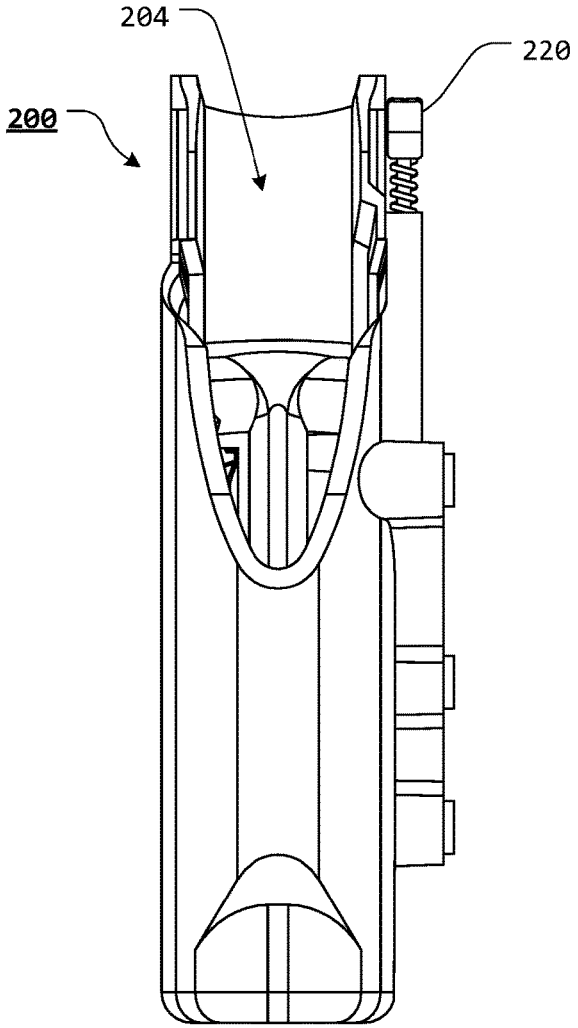
FIG. 27 illustrates a rear view of an exemplary embodiment of a holster, according to the present disclosure.

The release lever 220 and pushrod 235 are repeatably slidable, relative to the holster body 203, between a release lever retention position, as illustrated most clearly in FIG. 15, and a release lever release position, as illustrated in FIG. 16. In the release lever retention position, the first end of the pushrod 235 does not make sufficient contact with the helical portion 248 or the helical ramp surface 249 of the locking element 240 to cause the locking element 240 to rotate toward the disengaged or locking element release position. As the release lever 220 is urged downward, toward the release lever release position and the locking element 240, the first end of the pushrod 235 contacts the helical portion 248 and/or the helical ramp surface 249. As the release lever 220 (and the pushrod 235) continue to be urged toward release lever release position, interaction between the first end of the pushrod 235 and the helical ramp surface 249 of the helical portion 248 causes the locking element 240 to rotate, about the rotation pin 230.

Thus, when the pushrod 235 is slidably positioned within the pushrod channel 237, linear manipulation of the release lever 220 (movement either toward or away from the locking element 240), results in rotation of the locking element 240. Thus, the locking element 240 can be at least partially rotated relative to the holster body 203.

In various exemplary embodiments, the release lever 220 (and the pushrod 235) may optionally be biased to the release lever release position, whether a handgun 180 is present in the holster 200 or absent from the holster 200. In various exemplary embodiments, biasing of the release lever 220 (and the pushrod 235) may be accomplished by, for example, a release lever biasing element 239 secured between at least a portion of the holster body 203 and at least a portion of the release lever 220. In various exemplary embodiments, the release lever biasing element 239 may comprise a coil or other spring or any suitable spring mechanism or resilient element positioned around at least a portion of the pushrod 235.

When a handgun 180 is seated within the holster 200 and the locking element 240 is in the locking element retention position, at least a portion of the handgun locking portion 245 of the locking element 240 extends into at least a portion of the ejection port 184 of an inserted handgun 180 and contacts a surface of the ejection port 184 and resists a withdrawing force applied to the handgun 180, maintaining the handgun 180 within the at least partial cavity portion 204. When the locking element 240 is in the release position, the handgun locking portion 245 is withdrawn from the at least partial cavity portion 204, through the aperture 205, a sufficient distance to disengage from the ejection port 184 of the handgun 180 appropriately seated within the at least partial cavity portion 204 to allow the handgun 180 to be withdrawn from the at least partial cavity portion 204.

While the handgun locking portion 245 is primarily shown and described as being positioned so that the handgun locking portion 245 may extend into the at least partial holster cavity portion 204 and potentially engage a portion of the ejection port 184, it should be appreciated that the locking element 240 may be positioned at any portion of the holster body 203 so that the handgun locking portion 245 may extend into the at least partial holster cavity portion 204 and potentially engage any surface or shoulder of the handgun 180.

When the release lever 220 is in the release lever retention position, the handgun locking portion 245 protrudes to extend inside the at least a portion of the at least partial holster cavity portion 204 and inside a portion of the ejection port 184 of a handgun 180 that is seated in the holster 200 and, thereby, resist or block withdrawing or rearward movement of the handgun 180 and retain the handgun 180 in the holster 200.

During use or operation of the holster 200, the holster 200 is initially presented in an empty condition and, as a user begins to holster a handgun 180 in the holster 200, the handgun 180 is inserted into the at least partial cavity portion 204 of the holster, muzzle first, and is guided into position by at least some of the first wall portion 206, the second wall portion 207, the fourth wall portion 209, and the third wall portion 208.

In certain exemplary embodiments, wherein the ramp portion 246 is included and the terminal end of the handgun locking portion 245 protrudes far enough into the at least partial cavity portion 204 to contact the slide portion 183 or another portion of an inserted handgun 180, as the handgun 180 is inserted further into the at least partial cavity portion 204, an outer surface of the handgun 180 contacts and rides along the terminal end of the handgun locking portion 245 and/or the ramp portion 246, rotating the locking element 240 toward the locking element release position. When the handgun 180 is seated in the at least partial cavity portion 204, the ejection port 184 or another portion of an inserted handgun 180 passes a point of contact with the handgun locking portion 245.

Thus, the locking element 240 is rotated to the release position as the outer surface of the slide portion 183 contacts the handgun locking portion 245 of the locking element 240 and is automatically rotated to the locking element retention position, via the locking element biasing element 250, when the ejection port 184 has passed the handgun locking portion 245.

When the ejection port 184 has passed the handgun locking portion 245, the locking element 240 may be biased, via the locking element biasing element 250, to rotate the locking element 240 back to the locking element retention position. In the locking element retention position, at least a portion of the terminal end of the handgun locking portion 245 protrudes within the ejection port 184 of the handgun 180 a sufficient amount such that the substantially planar portion 247 engages a surface of the ejection port 184 to block the handgun 180 from being withdrawn from the at least partial cavity portion 204.

When the handgun 180 in seated in the at least partial cavity portion 204 the bias of the locking element 240 causes the locking element 240 to return to the locking element retention position. When the locking element 240 is biased to the locking element retention position, the handgun locking portion 245 protrudes, from the locking element 240, through the aperture 205 of the holster body 203, and engages a defining surface of the ejection port 184 of the handgun 180.

Thus, the handgun 180 is secured in the at least partial cavity portion 204 of the holster 200 by operation of the handgun locking portion 245 engaging a portion of the ejection port 184, thereby blocking removal of the handgun 180. While the handgun 180 is fully seated in the at least partial cavity portion 204, removal of the handgun 180 is not permitted.

In order to release and unholster the handgun 180, the user merely grasps the handgun 180 in a manner to establish a normal grip on the handgun 180. As the user's grip is established, the user's thumb contacts and applies a downward pressure to the release lever 220, urging the release lever 220 toward the locking element 240 and toward the release lever release position (typically by applying a force to the release lever 220 sufficient to overcome the biasing force of the release lever biasing element 239). As the release lever 220 is urged downward, toward the locking element 240, the first end of the pushrod 235 contacts the helical portion 248 and/or the helical ramp surface 249. As the release lever 220 (and the pushrod 235) continue to be urged toward the locking element 240, interaction between the first end of the pushrod 235 and the helical ramp surface 249 of the helical portion 248 causes the locking element 240 to rotate about the rotation pin 230.

As the release lever 220 is further urged toward the release lever release position, the bias of the locking element 240 is overcome, the locking element 240 is rotated towards the locking element release position, and the handgun locking portion 245 of the locking element 240 is at least partially withdrawn from the interior of the ejection port 184.

Thus, downward pressure on the release lever 220 (or urging the release lever 220 toward the locking element 240 and toward the release lever release position) causes interaction between the first end of the pushrod 235 and the helical ramp surface 249 of the helical portion 248 and rotational movement of the locking element 240 about the rotation pin 230.

When the release lever 220 has been urged to the release lever release position, the handgun locking portion 245 clears the ejection port 184, the ejection port 184 is no longer blocked by the handgun locking portion 245, and the handgun 180 can be withdrawn from the holster 200.

When the handgun 180 has been removed from the holster 200, interaction between the release lever biasing element 250 and the locking element 240 biases the locking element 240 to the locking element retention position and interaction between the release lever biasing element 239 and the release lever 220 biases the release lever 220 to the release lever release position.

The holster 200, as shown and described, is oriented such that the locking element 240 is generally accessible by the user's thumb. However, in various other exemplary embodiments, the locking element 240 may optionally be positioned so that it is generally accessible by one or more of the user's other fingers.

It should be appreciated that the holster 200 is generally illustrated as being a right-hand holster. However, the structure and/or elements of the holster 200 may be positioned so as to provide a left-hand holster.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A holster for receiving at least a portion of an inserted handgun, comprising:

a holster body defining an at least partial holster cavity;

a locking element, wherein said locking element extends from a rotation portion to a locking engagement portion, wherein said rotation portion includes a helical portion formed in or around at least a portion of said rotation portion, wherein said locking element includes a locking element pivot pin aperture formed through said rotation portion, wherein said locking engagement portion includes a handgun locking portion, wherein said locking element is pivotably attached or coupled to said holster body, via a locking element pivot pin positioned through at least a portion of said locking element pivot pin aperture and is repeatably rotatable between a locking element retention position and a locking element release position, wherein said locking element is biased to said locking element retention position, wherein in said locking element retention position at least a portion of handgun locking portion extends into said at least partial holster cavity to interact with a surface of an ejection port of inserted handgun, and wherein in said locking element release position said handgun locking portion is withdrawn from said at least partial holster cavity so as not to interact with a surface of said ejection port; and a pushrod, wherein said pushrod extends from a first end to a second end, wherein a release lever is attached or coupled to said second end of said pushrod such that said pushrod extends from said release lever, wherein at least a portion of said pushrod is slidably positioned within at least a portion of said holster body such that said pushrod and said release lever are repeatably slidable between a release lever retention position and a release lever release position, wherein said release lever is biased to said release lever retention position, wherein in said release lever release position interaction between said first end of said pushrod and said helical portion causes said locking element to rotate, about said rotation pin, to said locking element release position, wherein in said release lever retention position said first end of said pushrod does not make sufficient contact with said helical portion to rotate said locking element from said locking element retention position.

2. The holster of claim 1, wherein said locking element is substantially arcuate in overall shape.

3. The holster of claim 1, wherein said helical portion begins at or proximate a proximal end of said rotation portion and extends to at least a portion of a distal end of said rotation portion.

4. The holster of claim 1, wherein said helical portion comprises a helix or helical protrusion extending from at least a portion of said surface of said rotation portion.

5. The holster of claim 1, wherein said helical portion comprises a helix or helical recess extending from at least a portion of said surface of said rotation portion.

6. The holster of claim 1, wherein said handgun locking portion is formed of a protrusion on said locking element.

7. The holster of claim 1, wherein said handgun locking portion includes a ramp portion.

8. The holster of claim 1, wherein said at least partial at least partial holster cavity includes a holster slide portion and a holster trigger guard portion.

9. The holster of claim 1, wherein said handgun locking portion includes a substantially planar portion having a substantially planar surface formed so as to extend into at least a portion of said ejection port of said inserted handgun and engage said surface of said ejection port.

10. The holster of claim 1, wherein said rotation portion comprises a substantially cylindrical portion.

11. The holster of claim 1, wherein if said locking element is in said locking element retention position, at least a portion of said handgun locking portion extends through an aperture in a wall portion of said holster body and protrudes into a portion of said at least partial holster cavity.

12. A holster for receiving at least a portion of an inserted handgun, comprising:

a holster body defining an at least partial holster cavity;

a locking element, wherein said locking element extends from a rotation portion to a locking engagement portion, wherein said rotation portion includes a helical portion formed in or around at least a portion of said rotation portion, wherein said locking element includes a locking element pivot pin aperture formed through said rotation portion, wherein said locking engagement portion includes a handgun locking portion, wherein said locking element is pivotably attached or coupled to said holster body, via a locking element pivot pin positioned through at least a portion of said locking element pivot pin aperture and is repeatably rotatable between a locking element retention position and a locking element release position, wherein in said locking element retention position at least a portion of handgun locking portion extends into at least a portion of said at least partial holster cavity so as not to interact with a surface of an ejection port if said inserted handgun, and wherein in said locking element release position said handgun locking portion is at least partially withdrawn from at least a portion of said at least partial holster cavity so as not to interact with said surface of said ejection port; and a pushrod, wherein said pushrod extends from a first end to a second end, wherein a release lever is attached or coupled to said second end of said pushrod such that said pushrod extends from said release lever, wherein at least a portion of said pushrod is slidably positioned within at least a portion of said holster body such that said pushrod and said release lever are repeatably slidable between a release lever retention position and a release lever release position, wherein in said release lever release position interaction between said first end of said pushrod and said helical portion causes said locking element to rotate, about said rotation pin, to said locking element release position, wherein in said release lever retention position said first end of said pushrod does not make sufficient contact with said helical portion to rotate said locking element from said locking element retention position.

13. The holster of claim 12, wherein said locking element is substantially arcuate in overall shape.

14. The holster of claim 12, wherein said locking element is biased to said locking element retention position.

15. The holster of claim 12, wherein said release lever is biased to said release lever retention position.

16. The holster of claim 12, wherein said handgun locking portion is formed of a protrusion on said locking element.

17. The holster of claim 12, wherein said rotation portion comprises a substantially cylindrical portion.

18. The holster of claim 12, wherein if said locking element is in said locking element retention position, at least a portion of said handgun locking portion extends through an aperture in a wall portion of said holster body and protrudes into a portion of said at least partial holster cavity.

19. The holster of claim 12, wherein said locking element includes a locking element pivot pin aperture formed through said rotation portion, and wherein said locking element is pivotably attached or coupled to said holster body, via a locking element pivot pin positioned through at least a portion of said locking element pivot pin aperture.

20. A holster for receiving at least a portion of an inserted handgun, comprising:

a holster body defining an at least partial holster cavity;

a locking element extending from a rotation portion to a locking engagement portion, said rotation portion comprising a substantially cylindrical portion and including a helical portion formed in or around at least a portion of said rotation portion, said locking engagement portion including a handgun locking portion, said locking element is pivotably attached or coupled to said holster body and repeatably rotatable between a locking element retention position and a locking element release position, in said locking element retention position at least a portion of handgun locking portion extends into at least a portion of said at least partial holster cavity; and a pushrod extending from a first end to a second end and having a release lever attached or coupled to said second end such that said pushrod extends from said release lever, at least a portion of said pushrod being slidably positioned within at least a portion of said holster body such that said pushrod and said release lever are repeatably slidable between a release lever retention position and a release lever release position such that if said pushrod is urged to said release lever release position, interaction between said first end of said pushrod and said helical portion causes said locking element to rotate toward said locking element release position.

* * * * *